US005628300A

United States Patent [19]

Wallendorff

[11] Patent Number: 5,628,300

[45] Date of Patent: May 13, 1997

[54] ARCHERY BOW SIGHTING AND TUNING APPARATUS

[76] Inventor: Joseph L. Wallendorff, 7066 County Rd. 133, Steedman, Mo. 65077

[21] Appl. No.: 346,619

[22] Filed: Nov. 30, 1994

[51] Int. Cl.[6] ..... F41B 5/14; F41B 5/18

[52] U.S. Cl. ..... 124/1; 124/86

[58] Field of Search ..... 124/23.1, 35.2, 124/86, 88, 1; 33/265

[56] References Cited

U.S. PATENT DOCUMENTS

| | | | |
|---|---|---|---|
| 2,763,156 | 9/1956 | Garigal | 124/23.1 X |
| 4,858,589 | 8/1989 | Chang | 124/24.1 |
| 4,875,290 | 10/1989 | Finch | 33/265 |
| 4,993,397 | 2/1991 | Cryar et al. | 124/23.1 |
| 5,048,504 | 9/1991 | Ballard | 124/86 |
| 5,121,736 | 6/1992 | Hawk | 124/86 |
| 5,165,178 | 11/1992 | Seely | 33/265 |
| 5,201,123 | 4/1993 | Booe | 33/265 |
| 5,344,110 | 9/1994 | Scarpa | 124/86 X |
| 5,370,103 | 12/1994 | Desselle | 124/86 |

FOREIGN PATENT DOCUMENTS

| | | | |
|---|---|---|---|
| 2738460 | 3/1979 | Germany | 124/23.1 |

*Primary Examiner*—John A. Ricci
*Attorney, Agent, or Firm*—Richard J. Grundstrom

[57] ABSTRACT

The archery bow sighting and tuning apparatus consists of a telescoping base assembly held in a vertical position by a base. A standard is slidable within the telescoping base assembly. The standard is lockable once properly positioned. A base plate is rotatably attached to the top end of the standard. The base plate is lockable in a fixed position on the standard. An elevation plate member is pivotally attached to the base plate. A level adjustor pivots and holds the elevation plate member in regards to the base plate. A transition mounting bracket is rotatably attached to the elevation plate member. A transition enclosure is attached to the transition mounting bracket. In this manner the transition enclosure is rotatable about the elevation plate member. A elevation adjusting rod is used to control the rotation of the transition mounting bracket for the horizontal positioning of the transition enclosure. A transition piece is slidable within the transition enclosure. The transition piece has extensions extending outward from the sides of the transition enclosure. One is for a position indicator and the other is for mounting a trigger release. A transition shaft slides the transition piece within the transition enclosure as the shaft is rotated. The transition shaft can be rotated manually or by an electric motor. A bow mounting assembly is attached to the forward end of the transition enclosure for the mounting of a bow to the apparatus. A bow is mounted in the bow mounting assembly. The bow string is then attached to the trigger release. As the transition piece is drawn back by the rotation of the transition shaft, the string is drawn back to the proper draw length of the bow as indicated by the draw length indicator. Windage, level and elevation adjustments are made as appropriate for sighting the bow sights. The trigger is operated to shoot an arrow from the bow. The geometry of the bow can be exactly repeated and duplicated for sighting the bow sights and for the tuning of the bow itself.

20 Claims, 24 Drawing Sheets

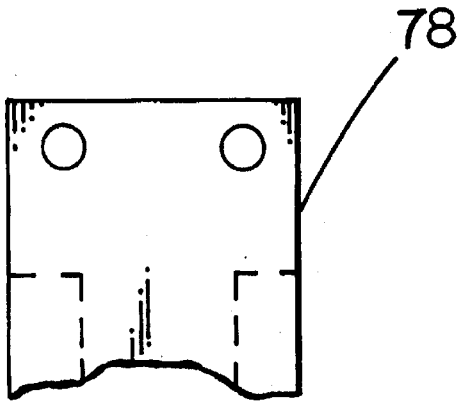
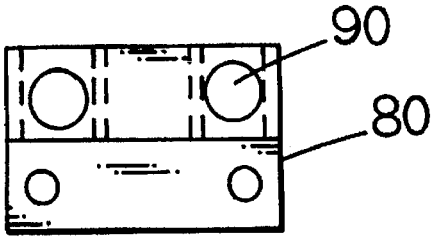
FIG.14C.
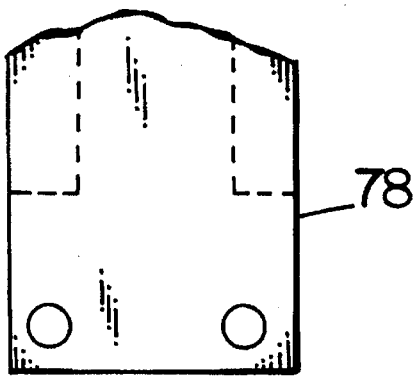
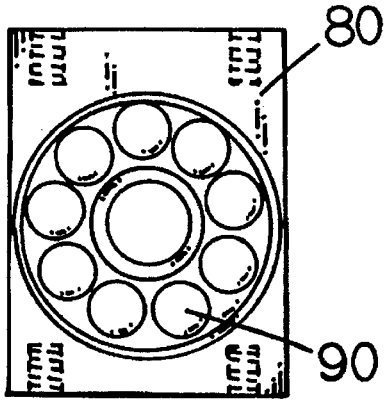
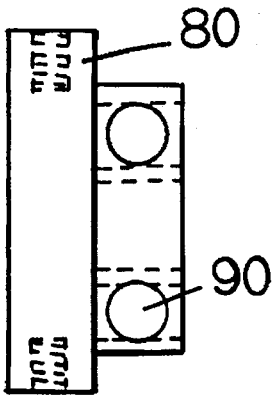
FIG.13C. FIG.14A. FIG.14B.
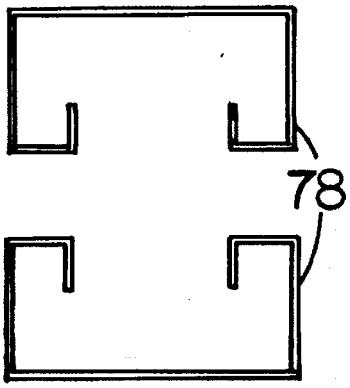
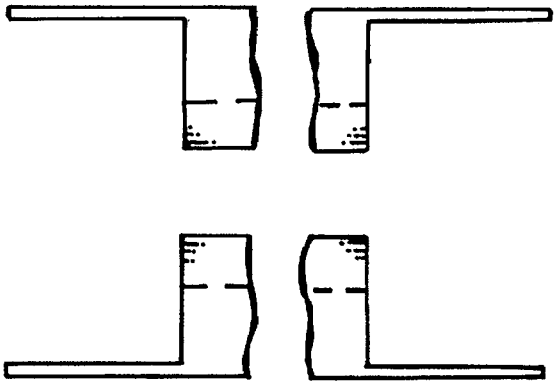
FIG.13A. FIG.13B.

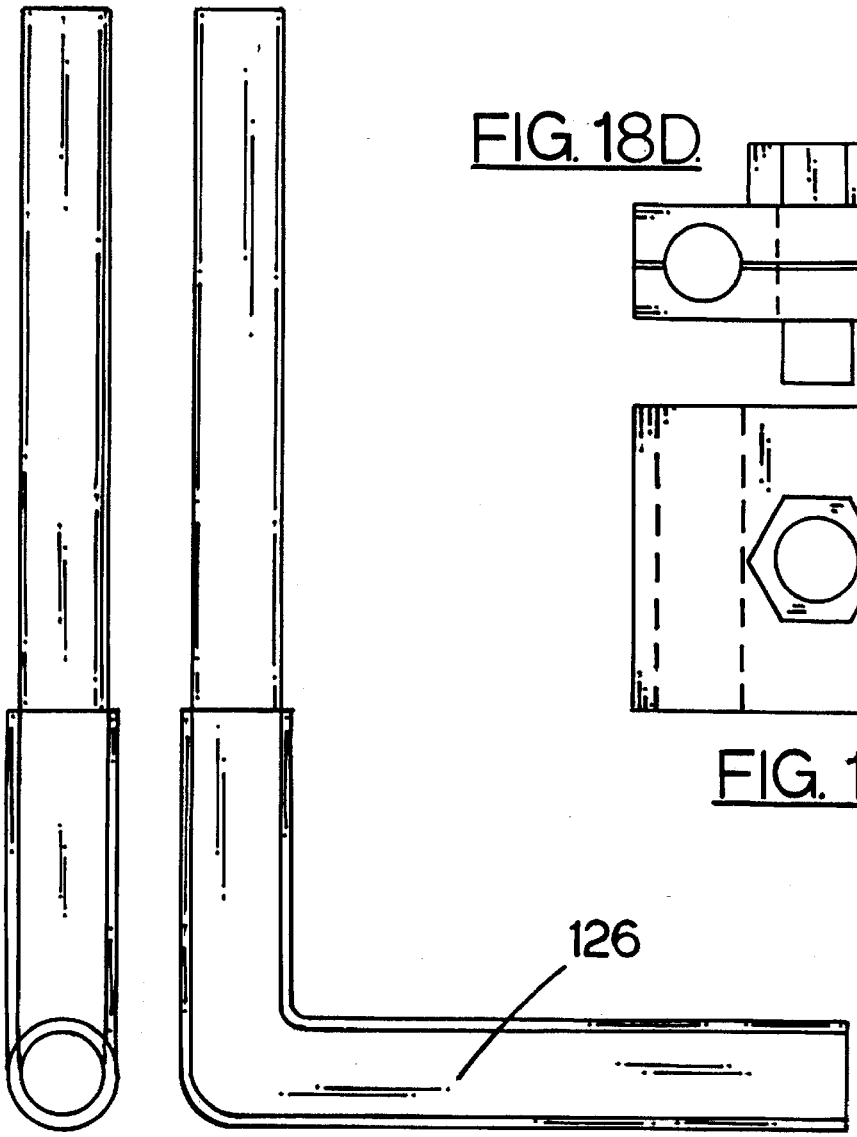
FIG. 18B.
FIG. 18A.
FIG. 18D.
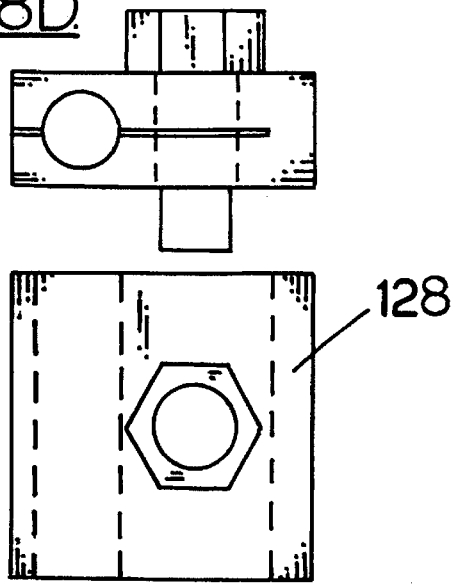
FIG. 18C.

ARCHERY BOW SIGHTING AND TUNING APPARATUS

BACKGROUND OF THE INVENTION

The present invention relates to an archery bow sighting and tuning apparatus and more particularly to a free standing apparatus on which an archery bow is attached for exactly sighting-in and tuning the bow.

Archery has been around for centuries and is a sport enjoyed by many men, women and children. The long bow and the recurve bow have the longest history but are generally on losing ground in the sport. The compound bow, patented in the '60's, is generally the bow of choice for most archers.

The field of archery has also become more technically advanced through the years. Numerous characteristics and differences are available on the different bows on the market. There is a large selection of various option and features available to the archer. There are also many sights, arrow rests, trigger releases, sound dampening devices, different type of arrows and arrow heads all available to the archer.

The ultimate goal of the archer is to shoot arrows accurately at a given target. To do this, the archer must practice his technic of shooting the bow and to "sight-in" and tune the bow for peak performance in accordance with his technic. Multiple arrows are typically shot from the bow in practice and for sighting-in the bow. However, it is practically impossible to repeatedly duplicate the stance, draw length and sighting necessary for exactly sighting and tuning the bow. Human error always plays a factor. Human error can include unsteadiness and muscle fatigue that interferes with exact sighting. The drawing back of the bow string and holding the string back in a drawn position requires strength and durability. The more the archer practices, the better and more fine tuned his technic becomes. As the technic becomes better and more precise, the bow can be sighted more exactly. However, most archers do not have the time to develop the technic to the advanced degree necessary to exactly sight-in and tune a bow.

The purpose of the archery bow sighting and tuning apparatus of this invention is to provide a means of exactly duplicating the geometry of shooting a bow repeatedly to "sight-in" and tune a bow for optimum performance. All human error in holding and shooting the bow is eliminated.

Other apparatuses are known in the art but each have disadvantages that this invention overcomes. Cryar et al., U.S. Pat. No. 4,993,387, is a frame mounted apparatus on which a bow is mounted for reproducing alignment of a bow for shooting an arrow. Hawk, U.S. Pat. No. 5,121,736, is also a frame mounted apparatus having a similar purpose. These inventions do not have the versatility of the present invention. There is no rotational or windage adjustment available or at the least it is very limited. Elevation adjustment is limited. Leveling means for uneven terrain is not provided for. The frames are bulky and in the way when trying to make bow adjustments.

Accordingly, it is an object of the present invention to provide an archery bow sighting and tuning apparatus that provides a means of repeatedly and exactly duplicating the geometry of shooting a bow for sight-in and tune a bow for peak performance.

Another object of the present invention is to provide an improved archery bow sighting and tuning apparatus constructed to provide for complete rotation of the bow for shooting in any direction, provide a wide range of elevation adjustment and to provide a means of leveling the apparatus on uneven ground. Adjustments as such are necessary for articulating the bow in all directions for exact aiming the bow at given targets and for adjusting the sights on the bow. Fine adjustments in elevation and windage are provided for minute changes in adjustment necessary for exact sighting.

A further object of the present invention is to provide an archery bow sighting and tuning apparatus adapted to overcome the disadvantages and limitations of the prior art.

Still another object of the present invention is to provide an archery bow sighting and tuning apparatus that is portable and can be taken to any shooting range, yet provide for a stable and unchanging shooting geometry.

Another object of the present invention is to provide an archery bow sighting and tuning apparatus that allows for height adjustment. The archery bow sighting and tuning apparatus of this invention allows archers, either short or tall, to adjust the height such that the archer can visually align the bow sights as if he where shooting the bow himself.

Still a further object of the present invention is to provide an archery bow sighting and tuning apparatus on which a dynometer can be attached for measuring bow performance.

Another object of the present invention is to provide an archery bow sighting and tuning apparatus that can be readily manufactured at a reasonable cost and of materials that are durable and allow for undistorted shooting.

Yet another objective of the present invention is to provide an archery bow sighting and tuning apparatus in which any bow, whether compound, long or recurve, can be attached and any trigger release wanted by the archer can be used.

SUMMARY OF THE INVENTION

To accomplish the foregoing and other objects of this invention there is provided an archery bow sighting and tuning apparatus and more particularly an apparatus on which an archery bow is attached for exactly sighting-in and tuning the bow for optimum performance.

The archery bow sighting and tuning apparatus of this invention generally consists of a telescoping base assembly held in a vertical position by a base. A standard is slidable within the telescoping base assembly for height adjustment. The standard is lockable once properly positioned. A windage swivel assembly having a base plate is rotatably attached to the top end of the standard. The windage assembly allows for 360 degree rotation. The base plate can be locked in a fixed position on the standard. An elevation swivel assembly having a plate member is pivotally attached to the base plate. A level adjustor pivots and secures the plate member in regards to the base plate to provide a means of leveling the apparatus on uneven ground. A transition mounting bracket is rotatably attached to the elevation plate member. A transition enclosure is attached to the transition mounting bracket. In this manner the transition enclosure is rotatable about the elevation plate member. An elevation adjusting rod is used to control the rotation of the transition mounting bracket for the horizontal positioning of the transition enclosure. The elevation can be adjusted from approximately a minus 20 degrees to positive 45 degrees. A transition piece is slidable within the transition enclosure. The transition piece has extensions extending outward from the sides of the transition enclosure. One extension is for a position indicator and the other is for mounting a trigger release. A rotatable transition shaft slides the transition piece within the transition enclosure as the shaft is rotated. The transition shaft can be rotated manually or by an electric motor. A bow mounting assembly is attached to the forward end of the transition enclosure for the mounting of a bow to the apparatus.

The above mentioned and other objects and features of the present invention will be better understood and appreciated from the following detailed description of the main embodiment thereof, selected for purposes of illustration and shown in the accompanying drawings.

DETAILED DESCRIPTION

Figure 1:
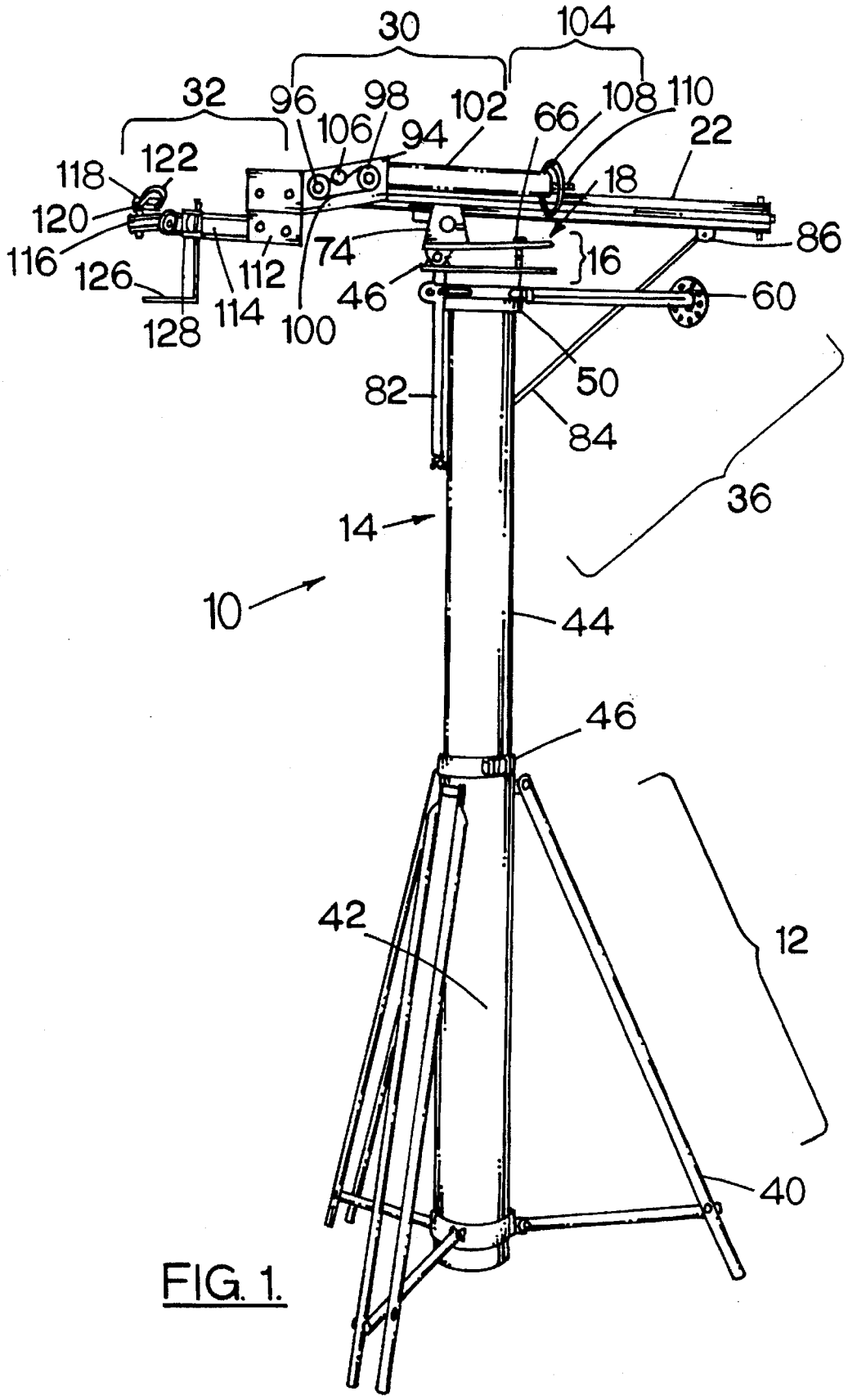
FIG. 1 is an isometric view of the archery bow sighting and tuning apparatus of this invention.
Figure 2:
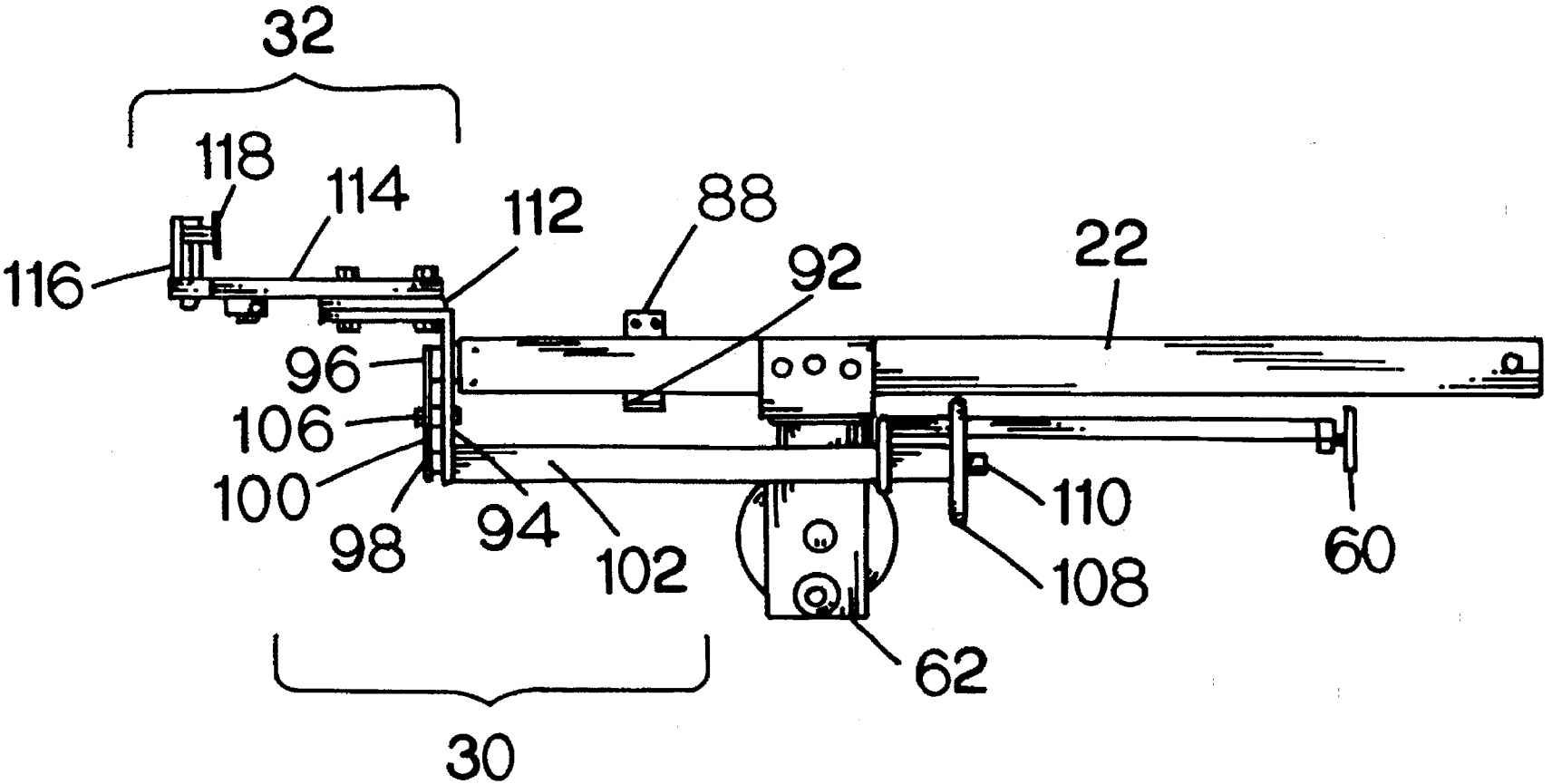
FIG. 2 is a top view of the archery bow sighting and tuning apparatus.
Figure 3:
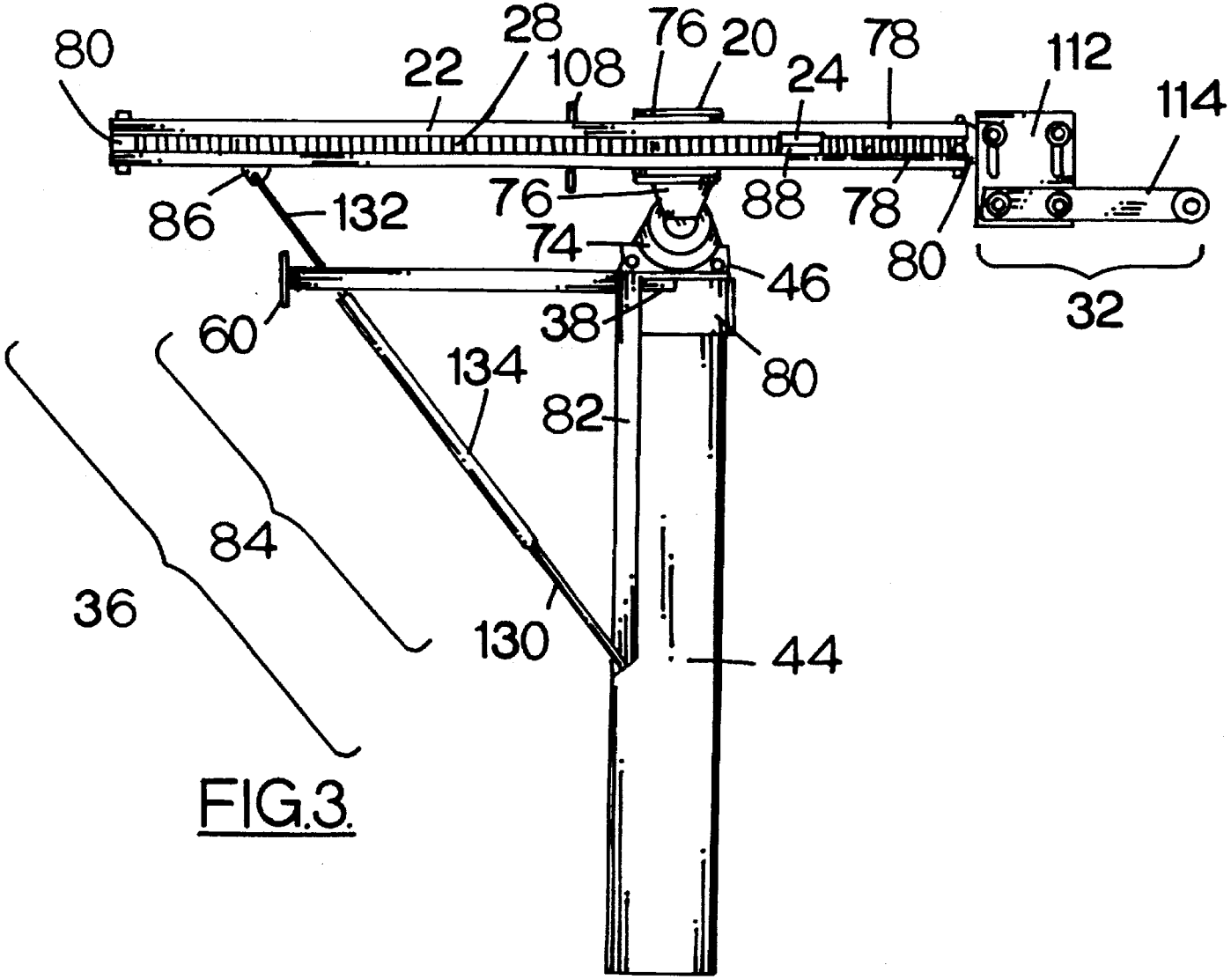
FIG. 3 is a right side view.
Figure 4:
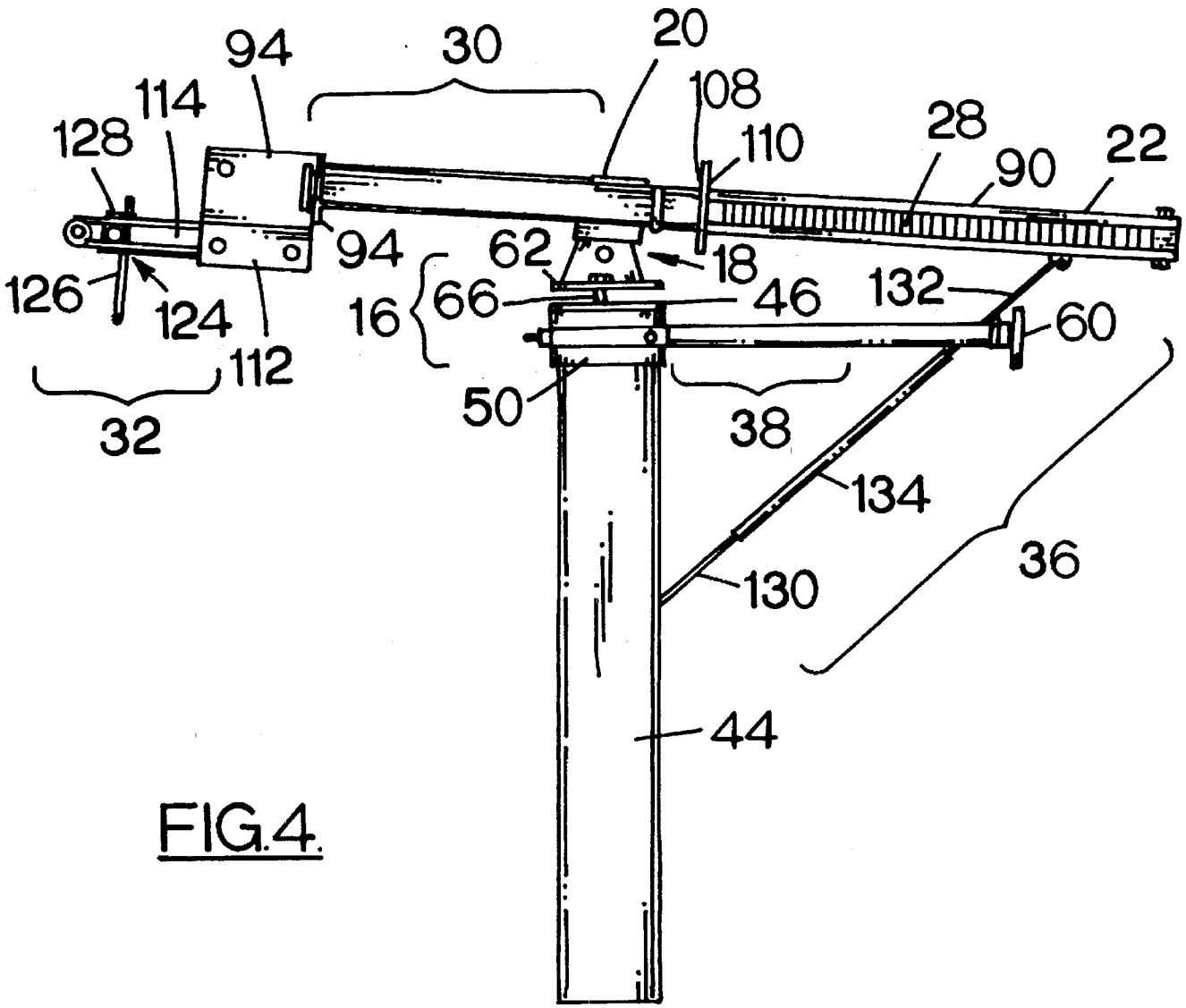
FIG. 4 is a left side view.
Figure 5:
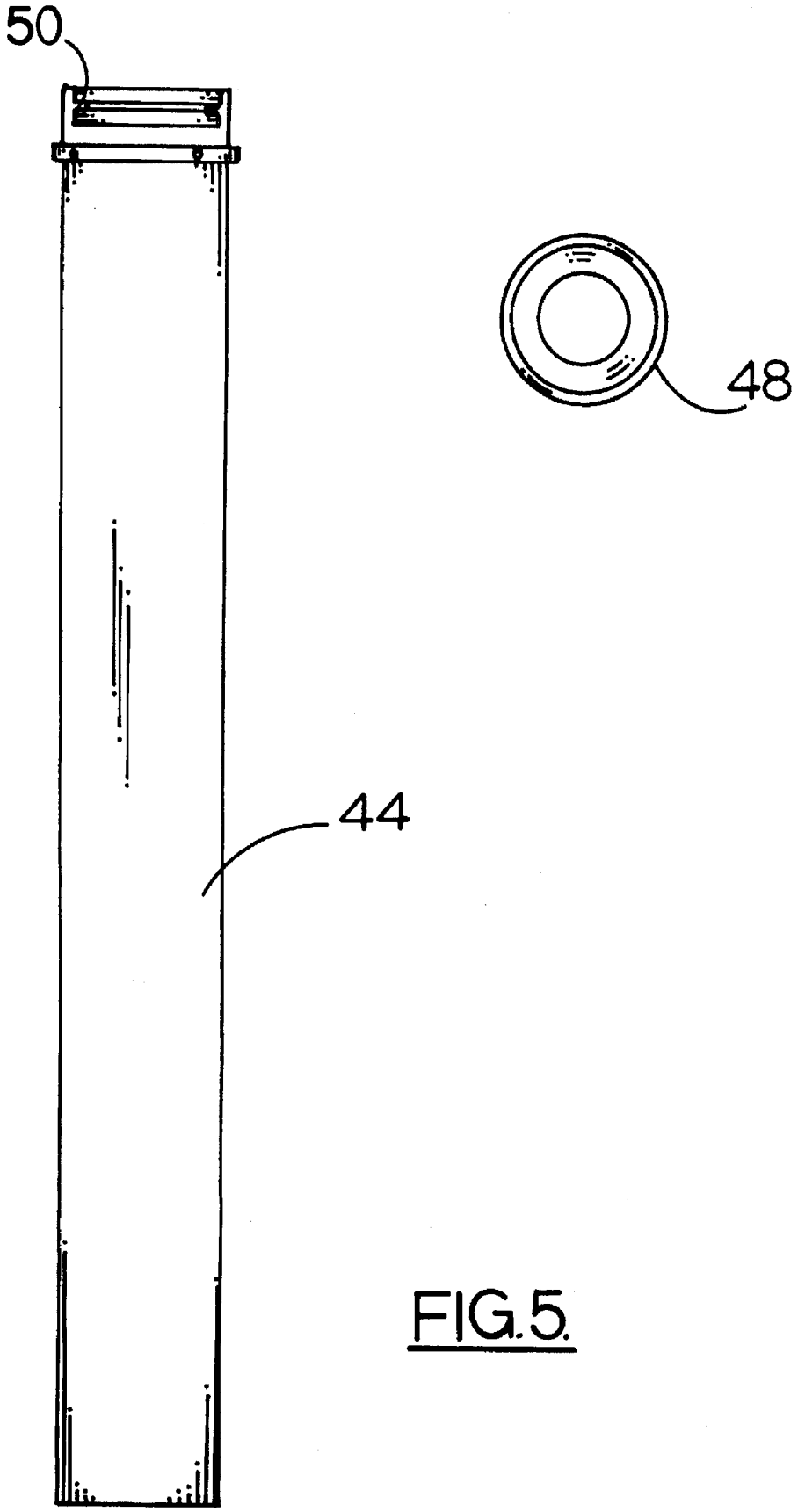
FIG. 5 is a view of the standard assembly.
Figure 7:
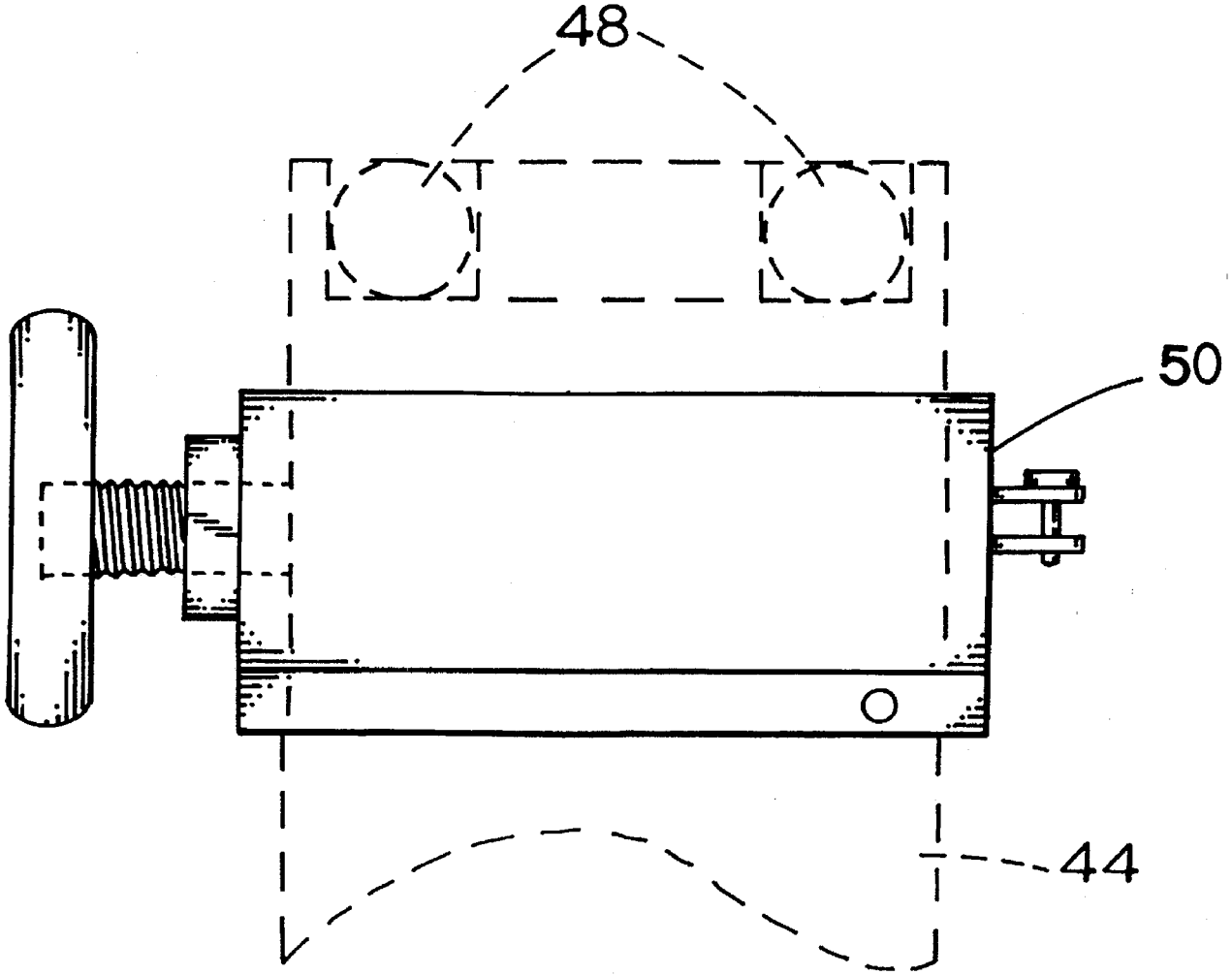
FIG. 7 is a view of the lock assembly.
Figure 8B:
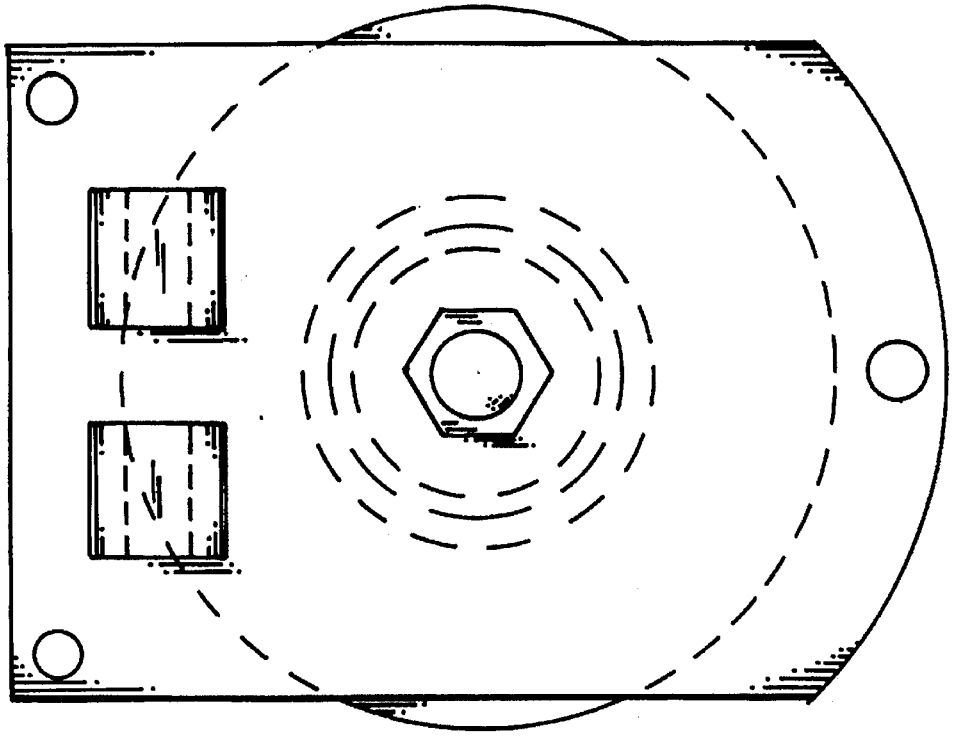
FIG. 8*b* is a top view of the windage swivel assembly.
Figure 8A:
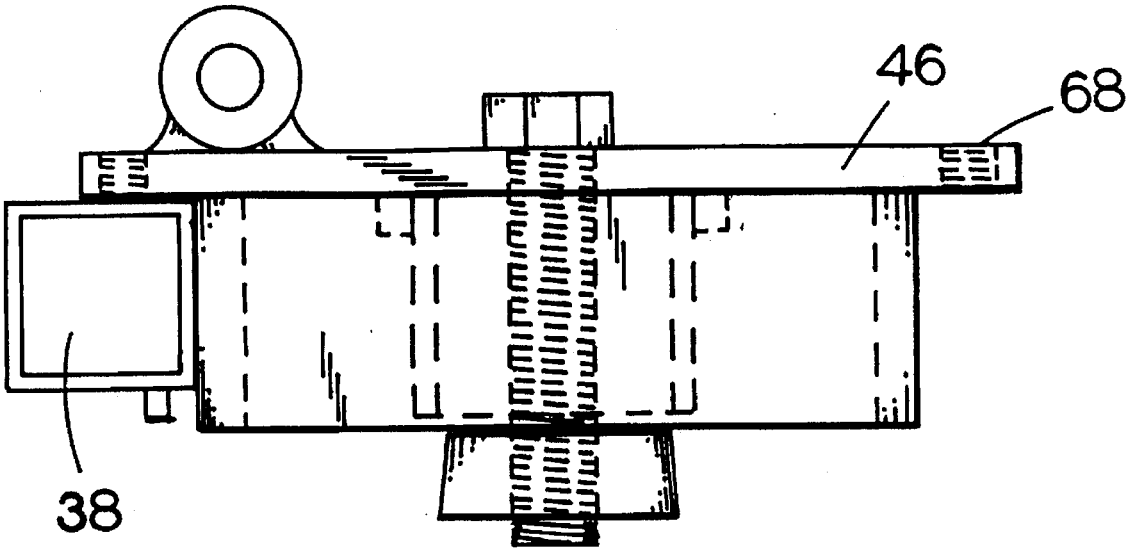
FIG. 8A is a side view of the windage swivel assembly.
Figure 9C:
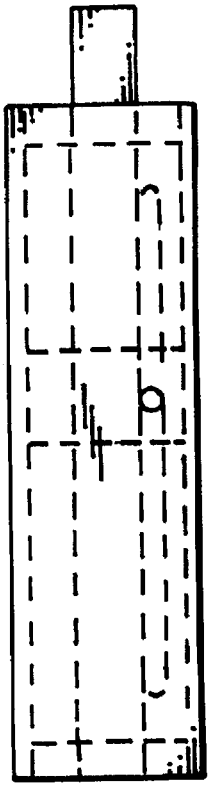
FIG. 9C is another view of the adjustor housing showing the adjustor rod and nut in phantom.
Figure 9D:
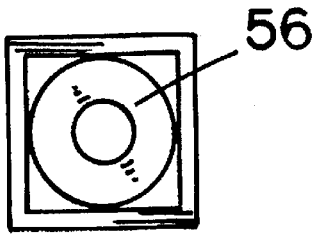
FIG. 9D is a end view of the windage adjustor housing showing the adjustor bearing.
Figure 9B:
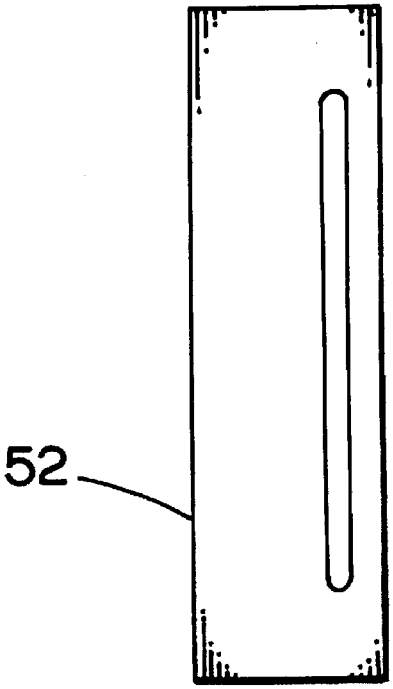
FIG. 9B is a side view side view of the adjustor housing.
Figure 9A:
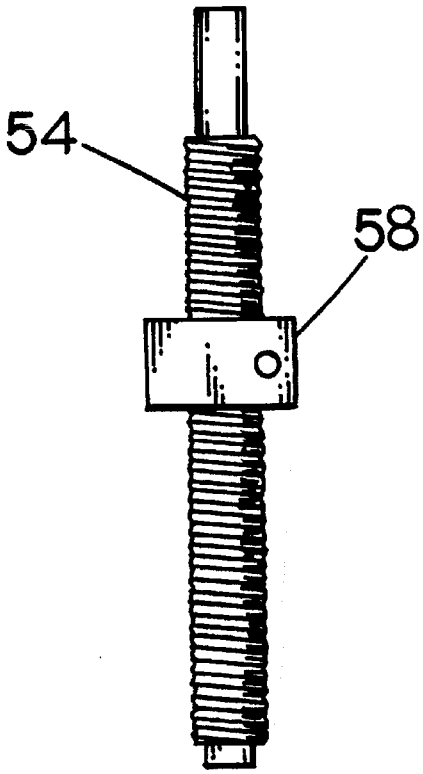
FIG. 9A is a side view of the windage adjustor rod and adjustor nut.
Figure 10A:
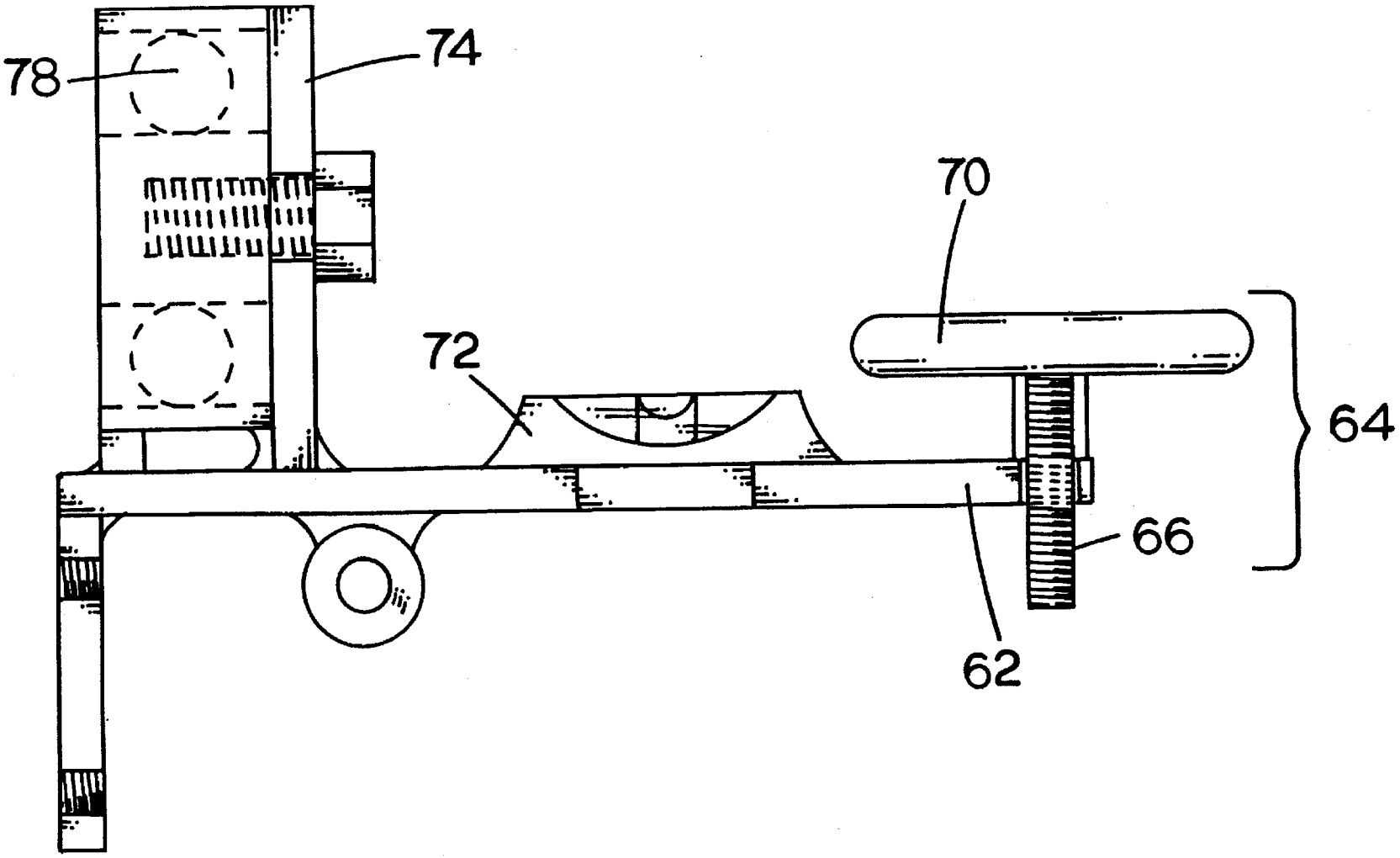
Figure 10C:
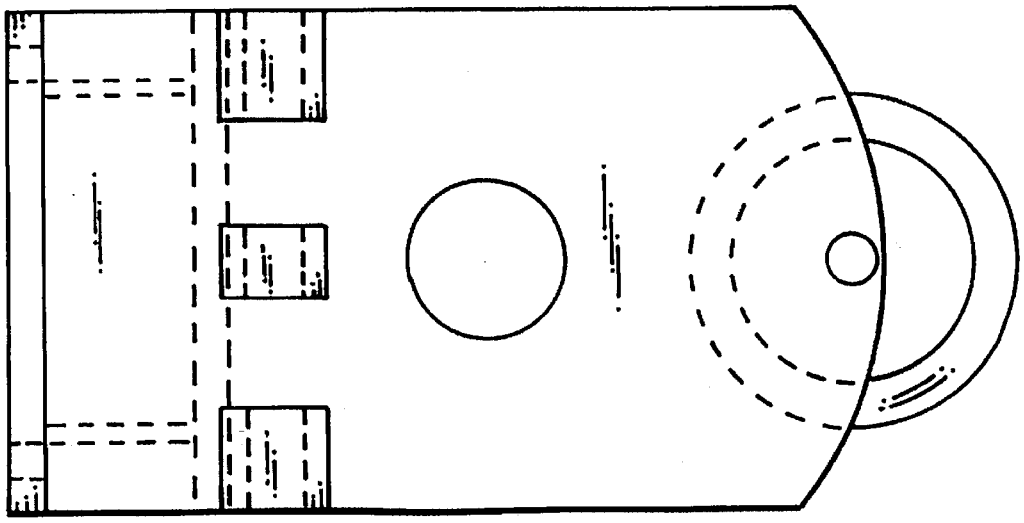
Figure 10B:
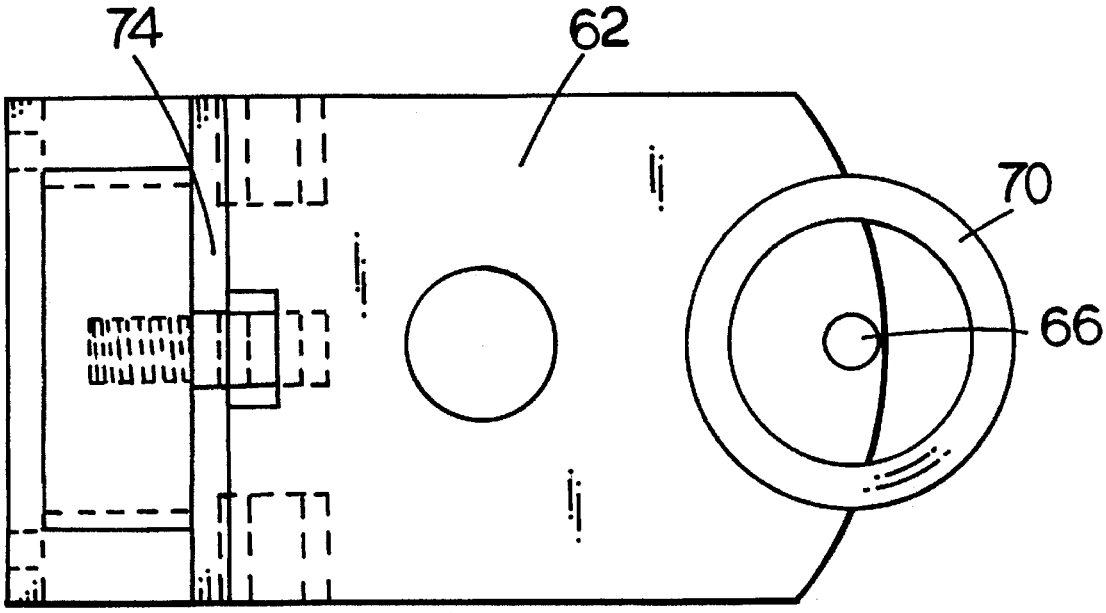
Figure 10E:
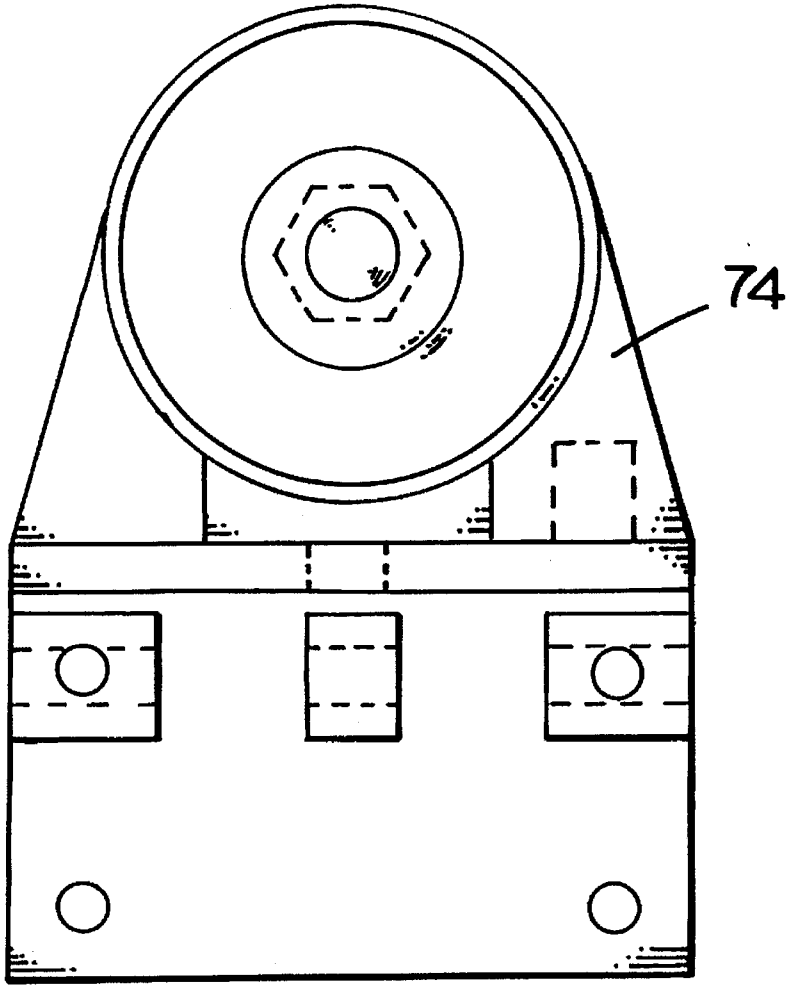
Figure 10D:
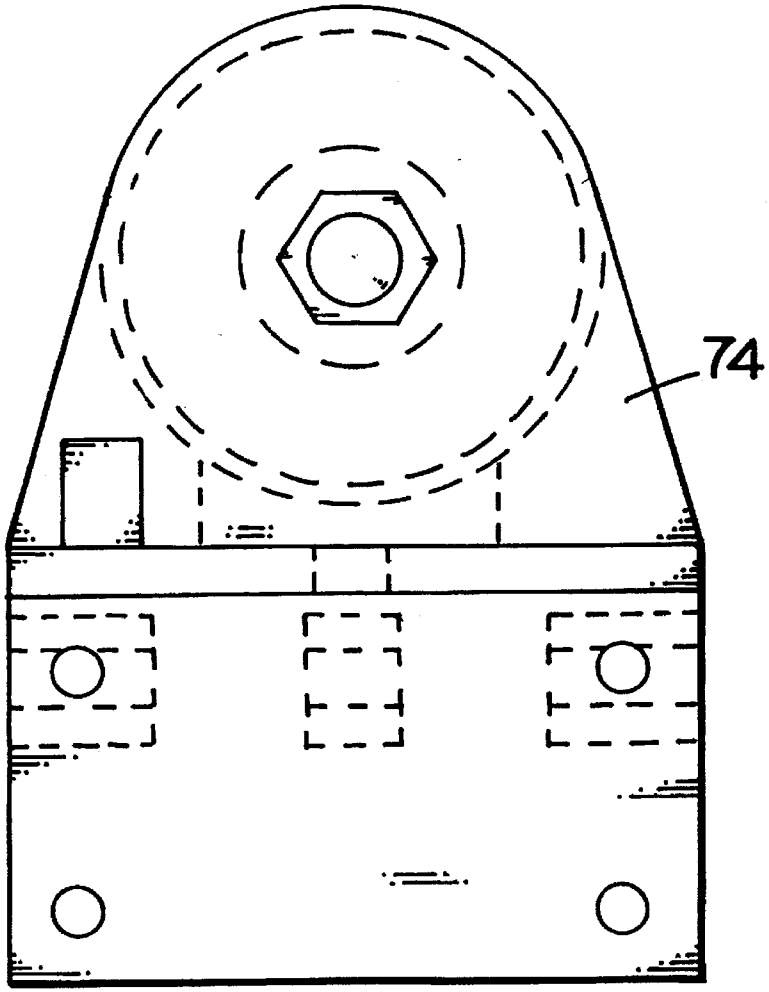
Figure 11B:
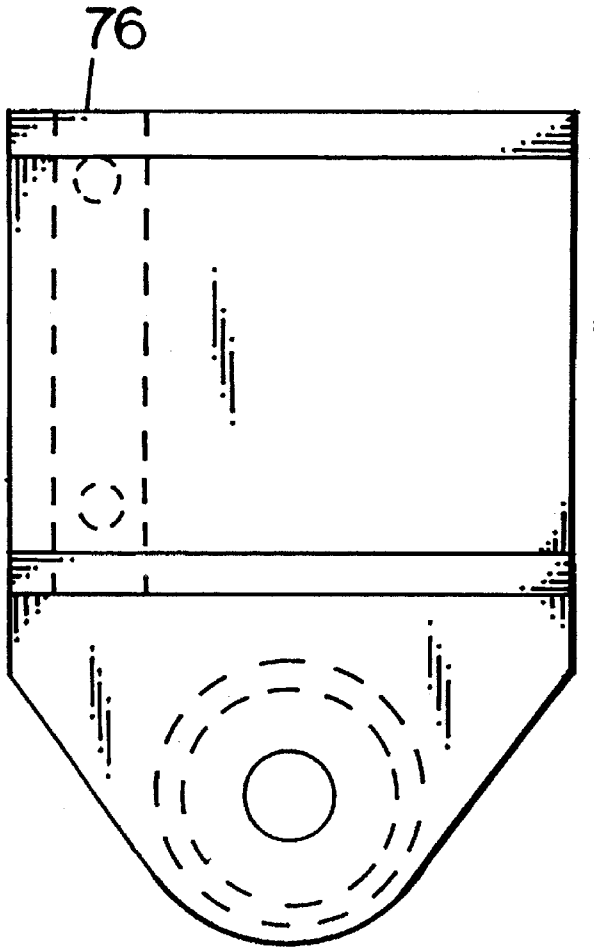
Figure 11A:
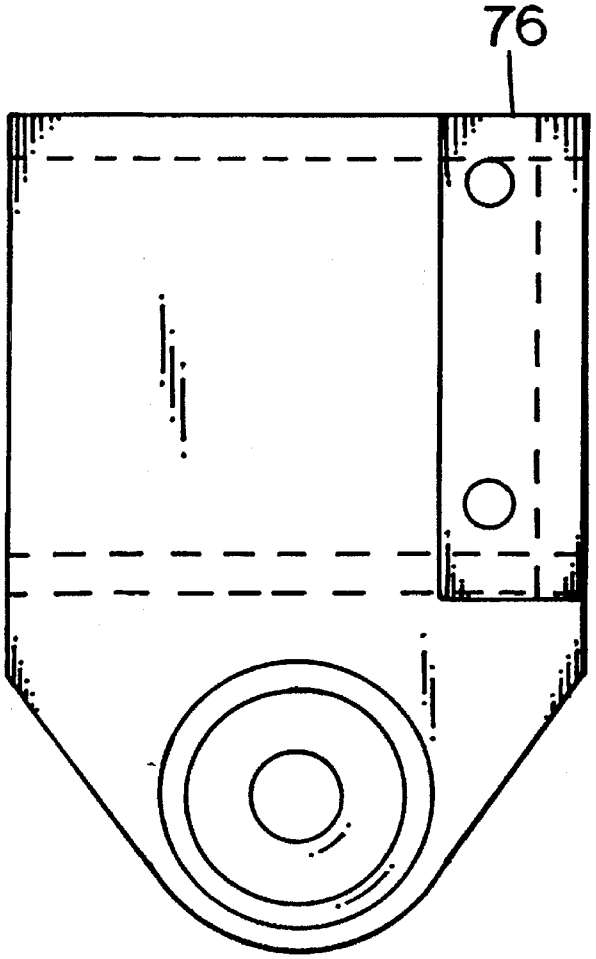
Figure 12B:
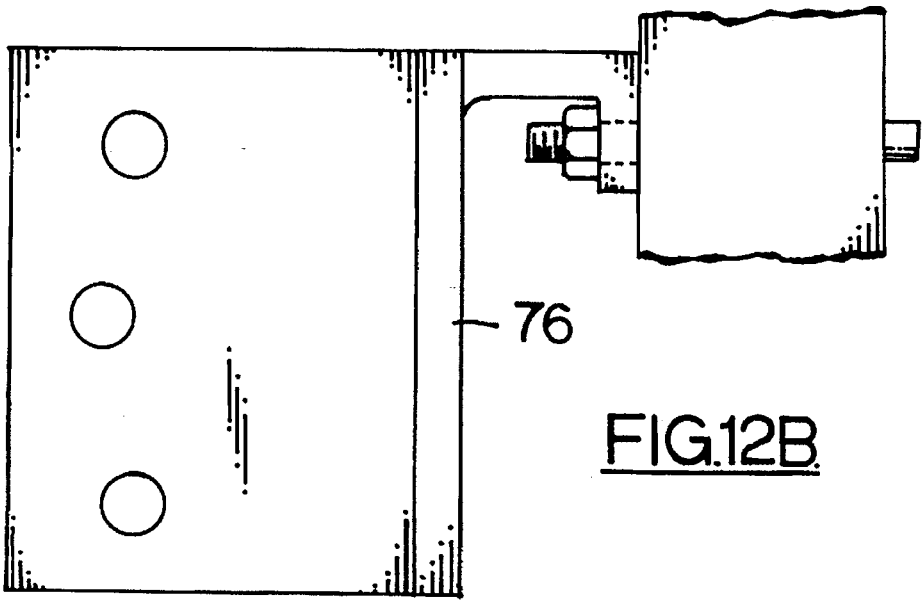
Figure 12A:
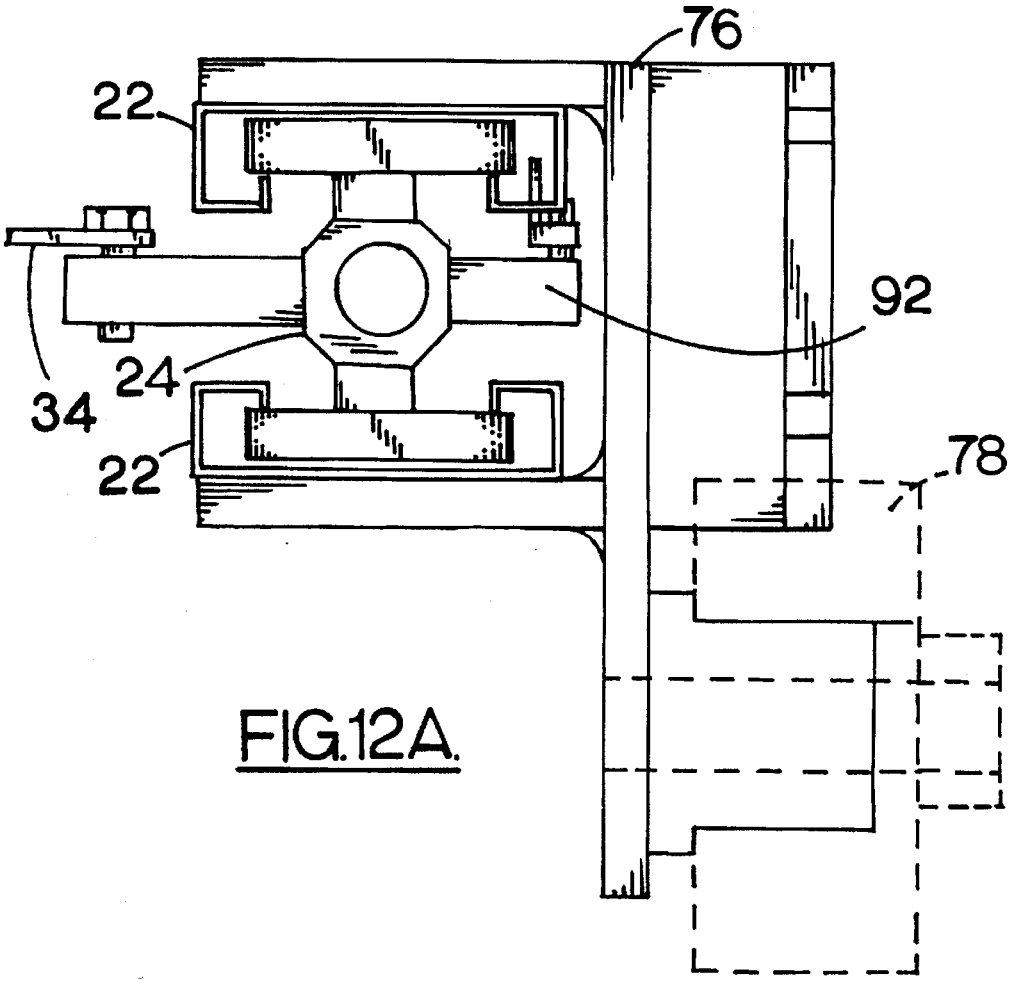
Figure 15:
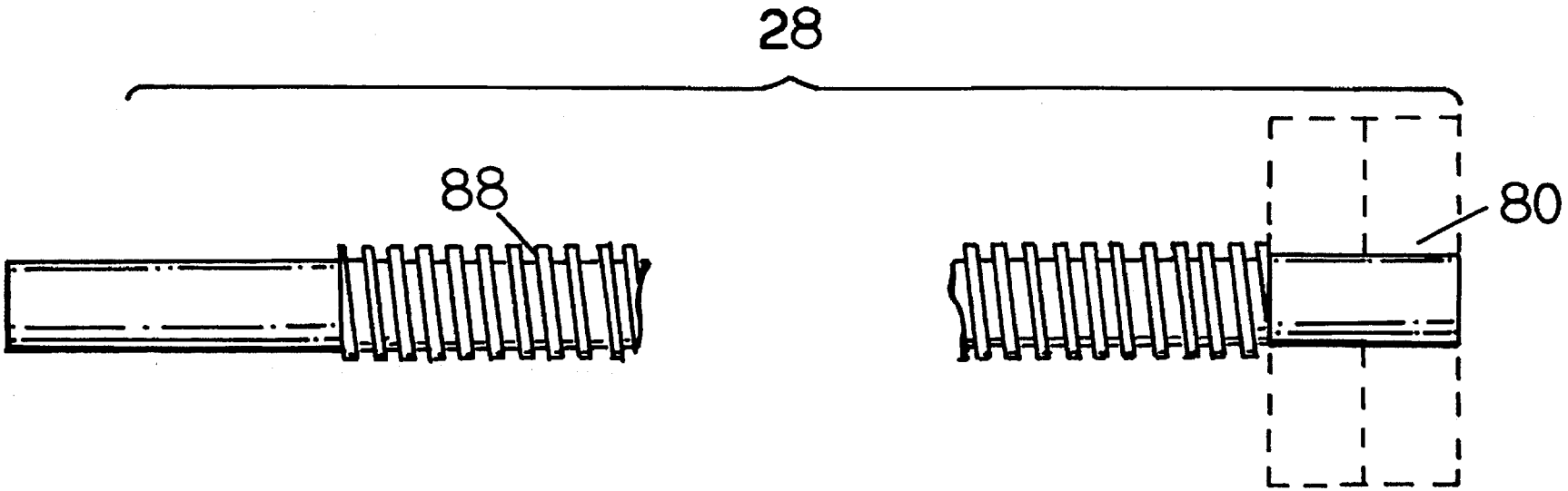
Figure 16C:
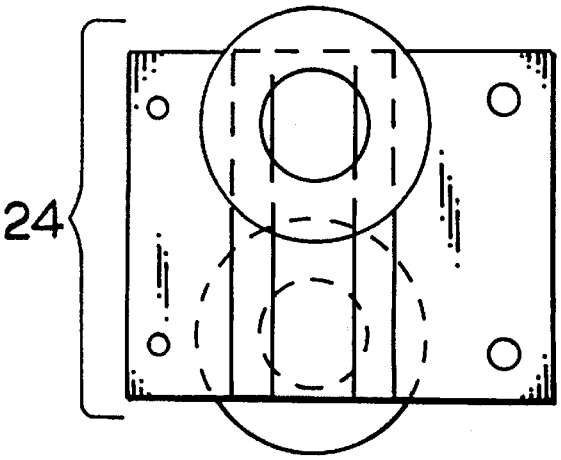
Figure 16B:
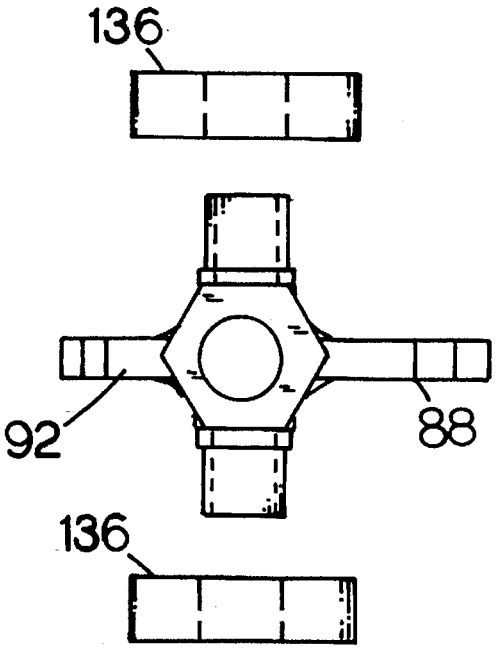
Figure 16A:
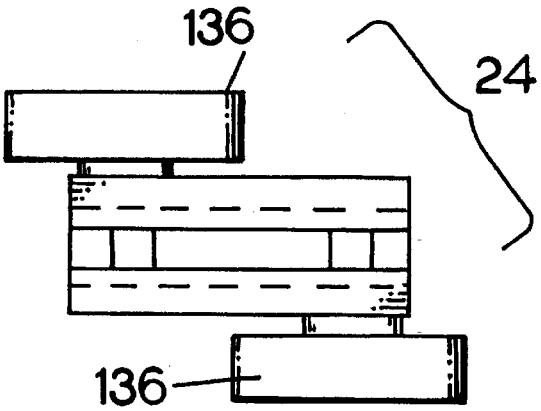
Figure 17B:
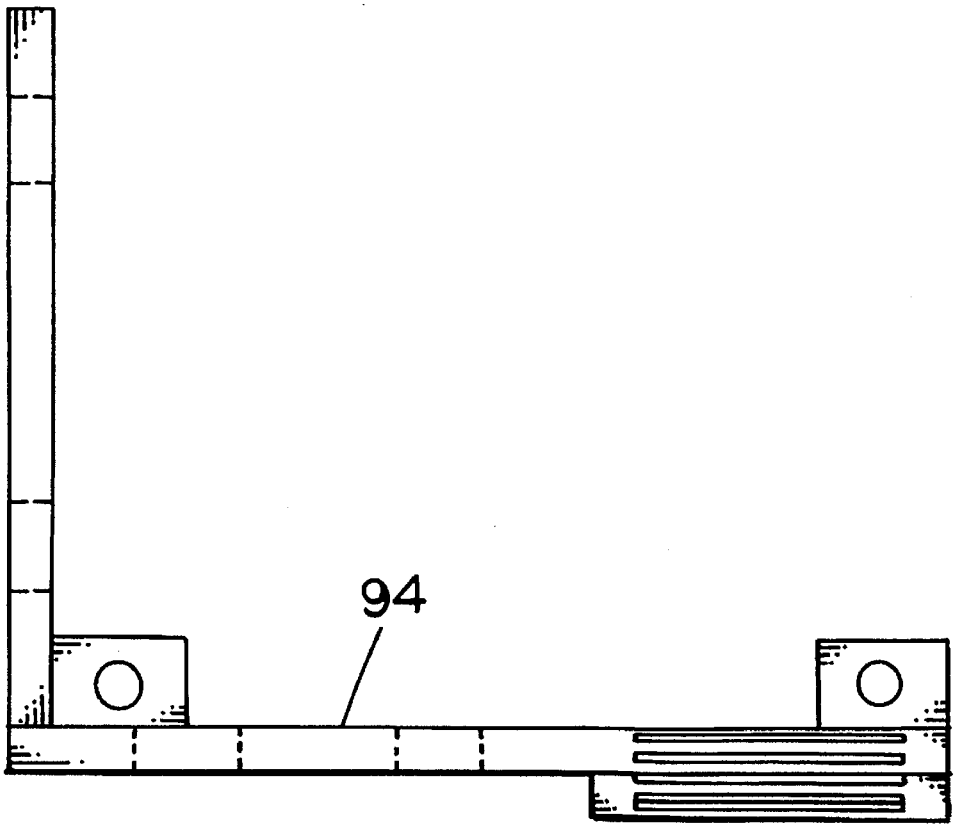
Figure 17A:
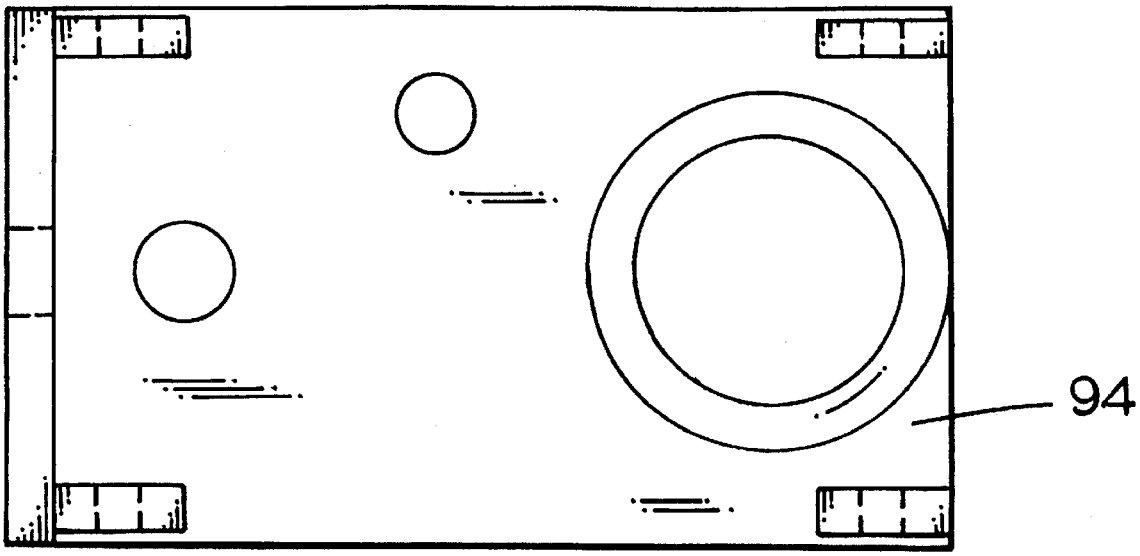
Figure 19A:
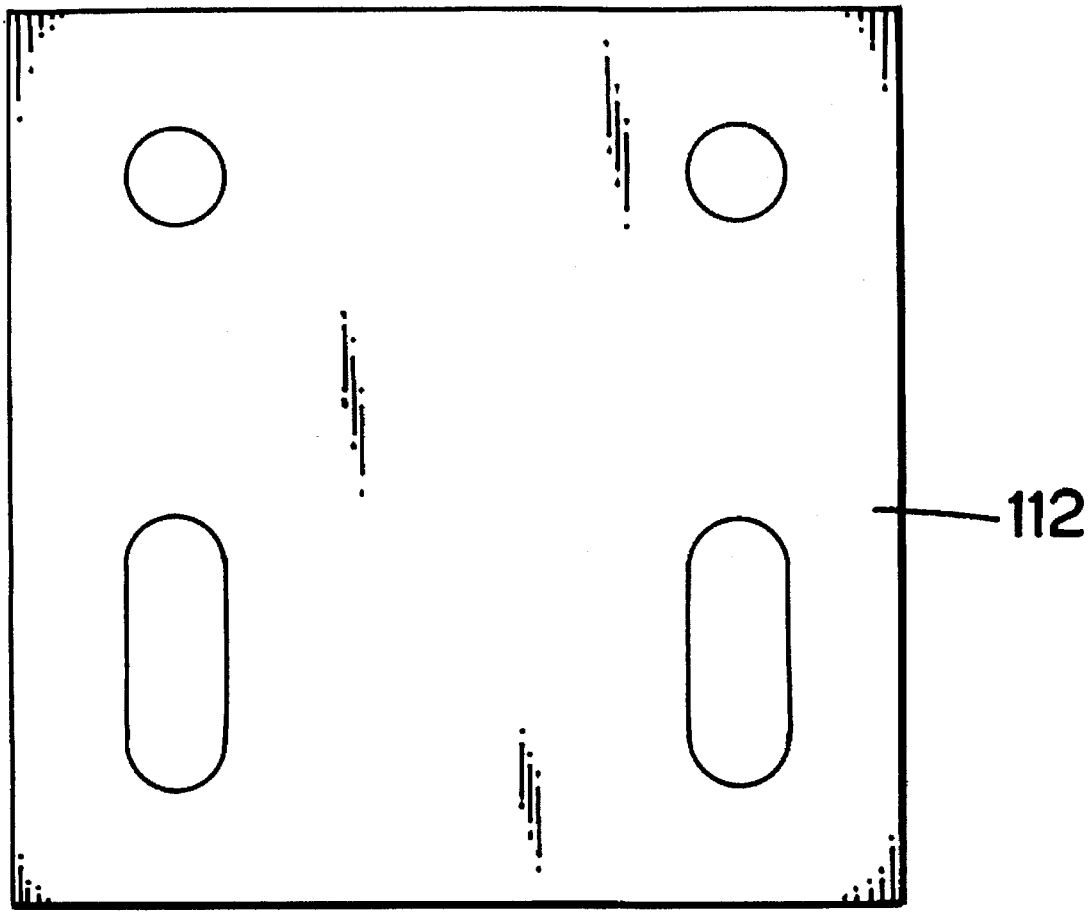
Figure 19B:
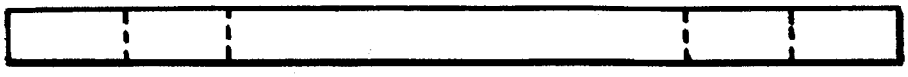
Figure 20B:
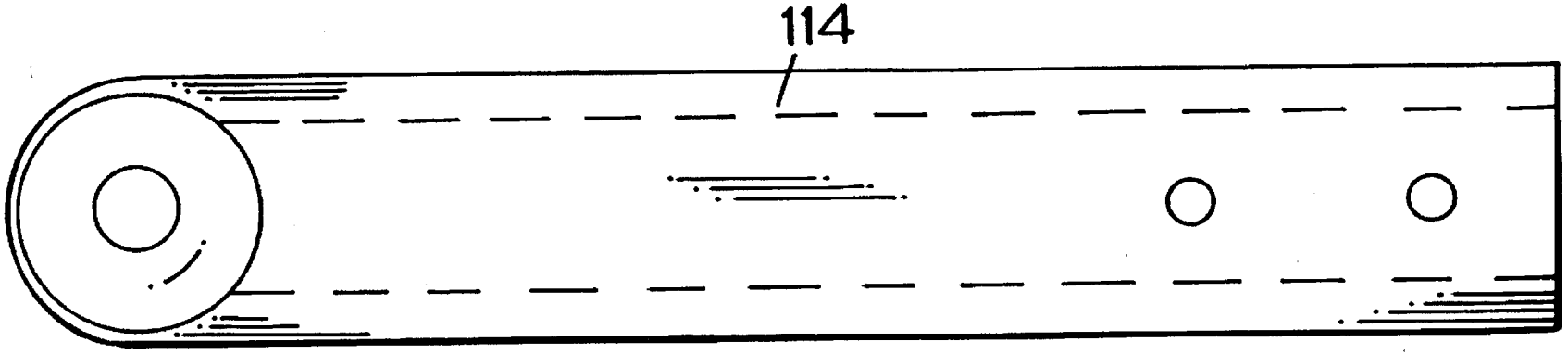
Figure 20A:
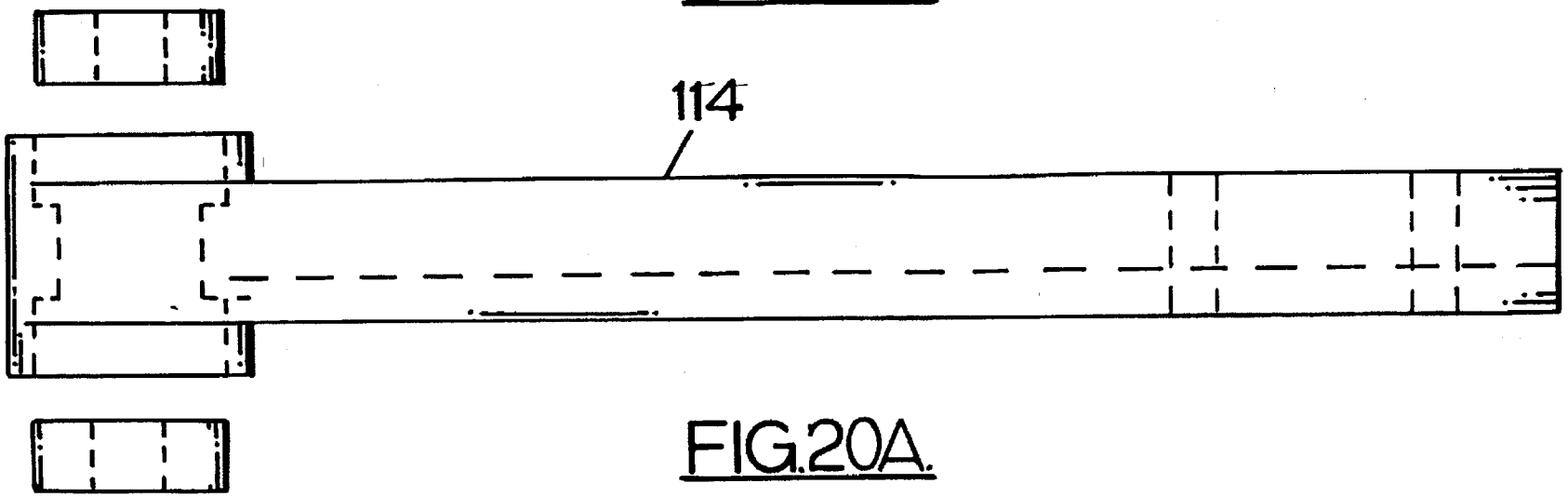
Figure 21A:
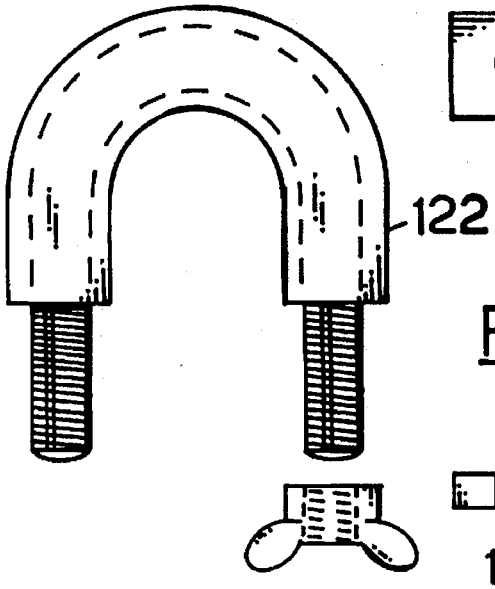
Figure 21C:
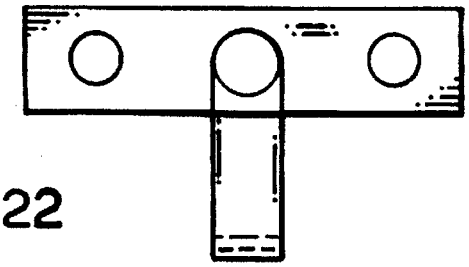
Figure 21B:
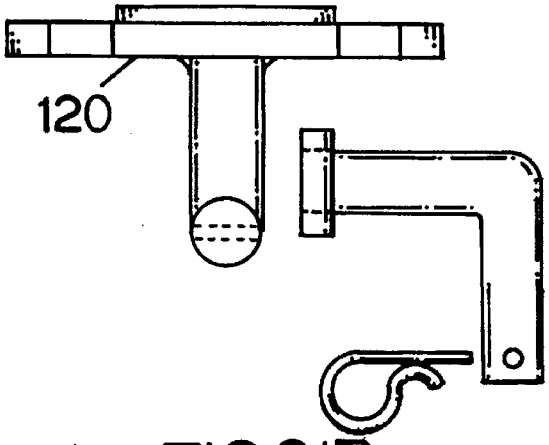
Figure 22B:
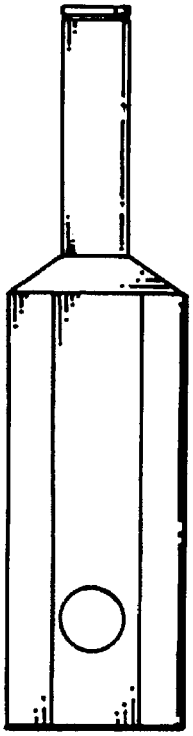
Figure 22A:
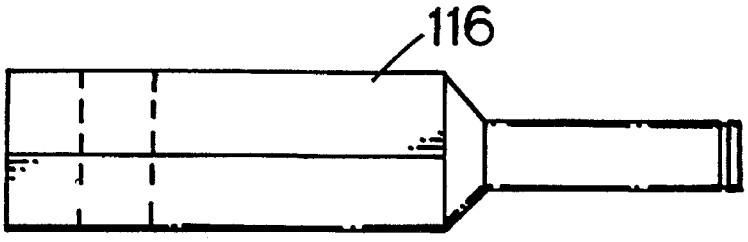
Figure 22C:
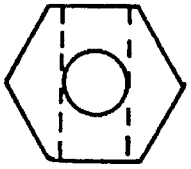
Figure 6:
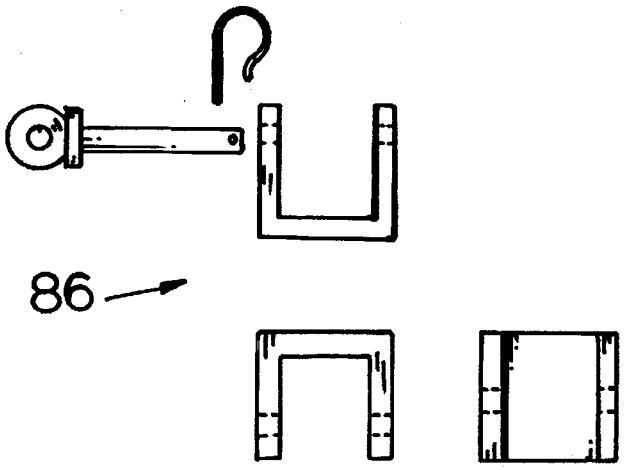
FIG. 6 is a view of the elevation adjusting mount.
Figure 23:
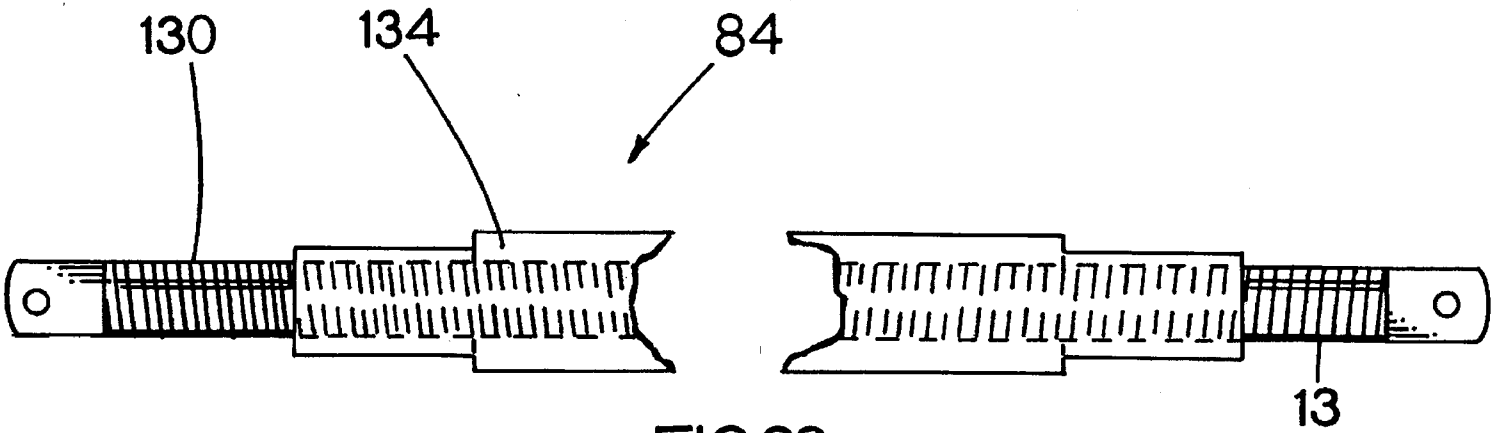
Figure 24C:
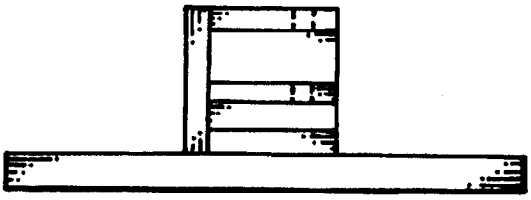
Figure 24D:
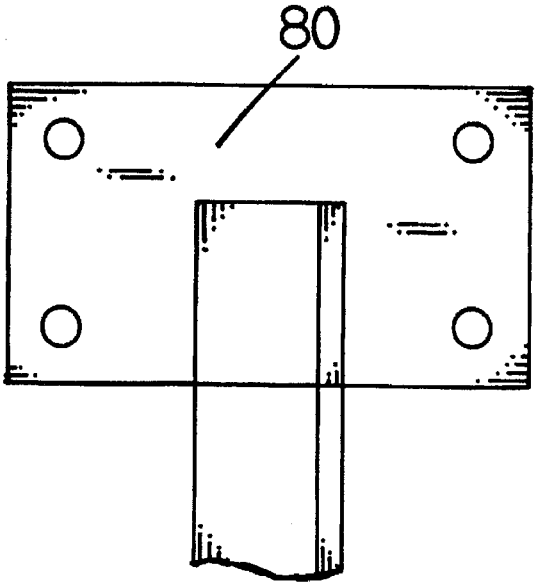
Figure 24D:
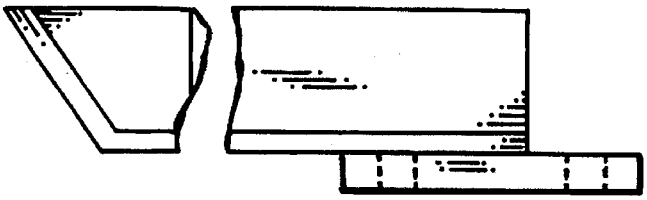
Figure 24B:
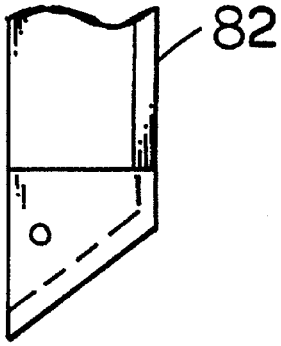
Figure 24A:
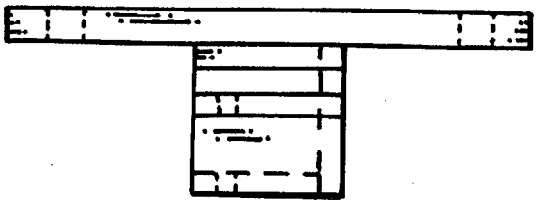
Figure 25:
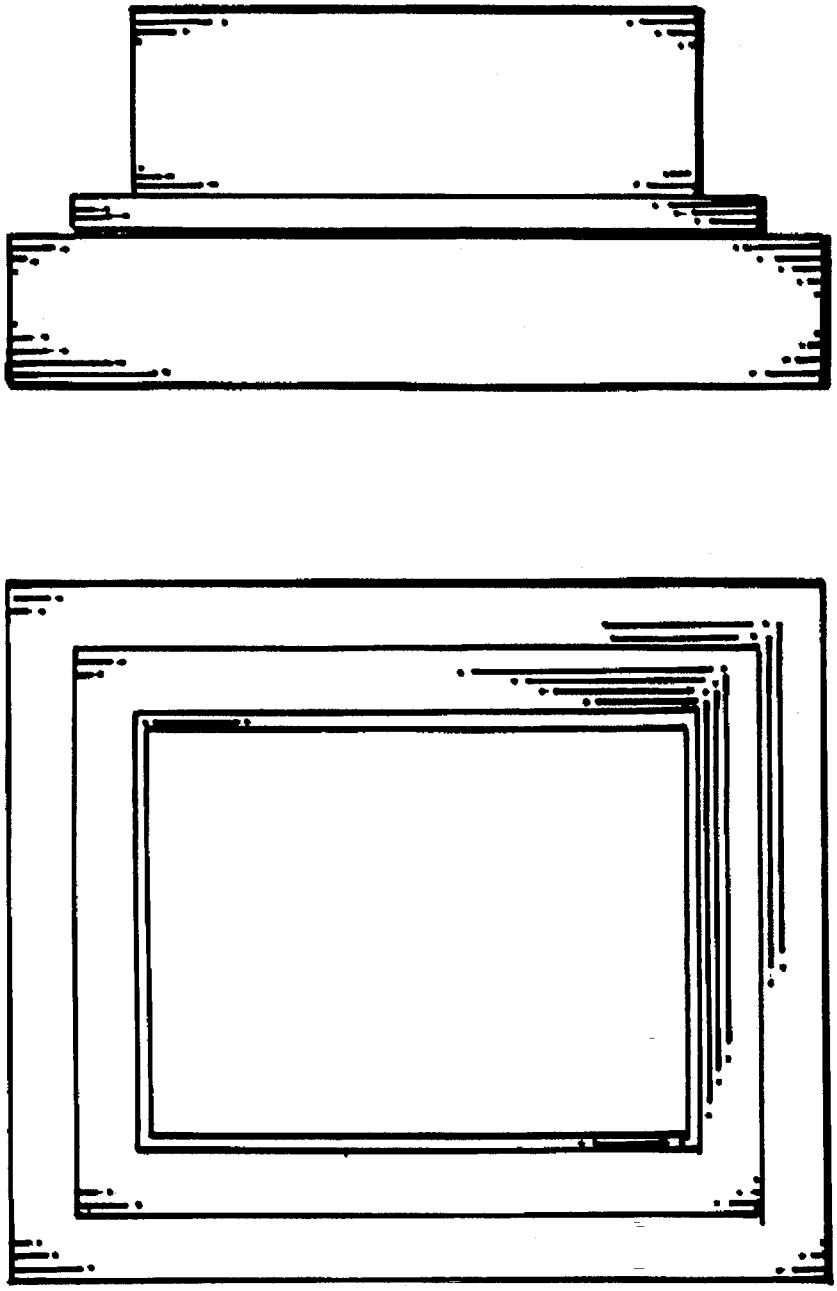

Referring now to the drawings there is shown a preferred embodiment of the archery bow sighting and tuning apparatus of this invention. The archery bow sighting and tuning apparatus 10 of this invention generally consists of a base assembly 12, a standard assembly 14, a windage swivel assembly 16, an elevation swivel assembly 18, a transition enclosure mounting bracket 20, a transition enclosure 22, a transition piece 24, a means of sliding and holding the transition piece 26 consisting of a transition shaft 28 and a drive assembly 30, and a bow mounting assembly 32.

In operation, a bow is attached to the bow mounting assembly 32. An arrow is placed on the bow in a shooting position. The string of the bow is attached to the transition piece 24 by a trigger release 34 and is drawn back by the means of sliding and holding the transition piece 24 to the specified draw length. The trigger release 34 is any typical trigger release available on the market as desired by the archer. The bow on the apparatus 10 is than adjusted horizontally by an elevation adjustment means 36. The windage is adjusted by a windage adjustment means 38. These adjustments are used to align the sights of the bow on a target. Using this apparatus 10, the geometry of shooting the arrow from the bow can be repeated exactly for any number of repeated shoots. In this manner and because of the duplication of the exact geometry, the bow sights can be adjusted exactly and the bow can be fine tuned to achieve the optimum performance. The apparatus 10 eliminates the human error in holding and shooting an arrow from the bow during the sighting-in process. No human can hold a bow as still or as stable and no one can repeatedly duplicate the geometry as exactly as this apparatus.

The preferred embodiment and the best mode contemplated of the archery bow sighting and tuning apparatus of the present invention are herein described. However, it should be understood that the best mode for carrying out the invention hereinafter described is offered by way of illustration and not by the way of limitation. It is intended that the scope of the invention include all modifications that incorporate its principal design features.

The base assembly 12 in the preferred embodiment has a plurality of supporting legs 40 and a vertical support member 42. The vertical support member 42 is supported in a vertical position by the supporting legs 40. As illustrated in the drawings and in the best mode contemplated, the supporting legs 40 and the vertical support member 42 forms a tripod by the plurality of legs.

It should be noted at this time that the components of the archery bow sighting and tuning apparatus 10 of this invention are principally made of metals, and more particularly steel. The apparatus, in the best mode contemplated, weighs approximately 110 pounds. The weight of the apparatus 10 must be sufficient to overcome the recoil of firing the bow yet be mobile enough that an archer can transport the apparatus 10 to a shooting range. The weight is necessary to duplicate the geometry of shooting an arrow from the bow as often as necessary to properly sight and tune the bow without undue adjustment and repositioning. The weight is approximately that of a small archer. The apparatus made of metals is also durable and resistant to deformation during use, which is also important in the duplication of geometry. Other material could also be used and substituted without departing from the scope and spirit of this invention as long as the materials used provide necessary characteristics to achieve the exact duplication of geometry. Other prior art apparatuses used springs and other means to absorb the recoil because they are not stable enough to maintain their position when a bow was fired. This problem is overcome by the present invention.

A standard assembly 14 consists of a standard 44 and other components later described. The standard is basically a tube member 44 slidable within the vertical support member 42 in a telescopic manner. This provides height adjustment for the apparatus 10. The height of the apparatus would typically be adjusted to allow an archer to sight through the bow sights as if he were shooting the bow. Once the bow is at the desired height it is locked into position by a clamp 46. The clamp 46 tightens the top edge of the vertical support member 42 against the standard 44. Height adjustment as such was typically not provided for in the prior art.

The windage swivel assembly 16 is best described as a base plate 46 rotatably attached to the top end of the standard 44. In the best mode contemplated, a roller bearing 48 is installed within the top end of the standard 44. A recess 50, in the preferred embodiment, is provided within the end of standard 44 to receive the bearing 48. The necessary hardware (i.e., bearing stand off ring, bearing race, nut and bolt) is attached to the bottom of the base plate 46 for attaching and allowing the base plate 46 to rotate on top of the standard 44.

The windage swivel assembly 16 is manually rotated on the standard 44 to provide gross windage adjustment. Once in proper position a windage bracket 50, at the top of the standard 44, is tightened to lock the windage swivel assembly 16 in position.

A windage adjustment means 38 provides for fine adjustment of the windage swivel assembly 16. The windage adjustment means 38, in the preferred embodiment, is attached to the bottom of the base plate 46 for fine rotational adjustment of the windage swivel assembly 16 in respect to the standard assembly 14.

The windage adjustment means 38, in the preferred embodiment, consists of an adjustor housing 52 attached to the base plate 46 of the windage swivel assembly 16. A threaded adjustor rod 54 is rotatably installed between bearings 56 contained within the adjustor housing 52. An adjustor nut 58 having a threaded bore engages the threaded adjustor rod 54 such that the adjustor nut 58 moves within the adjustor housing 52 as the adjustor rod 54 rotates. Typically, a handwheel 60 is used for rotating the threaded adjustor rod 54. The handwheel 60 may be attached directly to an end of the threaded adjustor rod or an extension may be used. The adjustment nut 58, in the preferred embodiment, engages the standard assembly 44 for rotating the windage swivel assembly 16 in respect to the standard assembly 14 as the threaded adjustment rod 58 is rotated.

Prior art apparatuses were typically fixed in one general direction. Whereas, this invention allows for shooting in any direction, 360 degrees without moving the base assembly 12.

The elevation swivel assembly 18 basically consists of a plate member 62 that is pivotally attached to the base plate 46 of the windage swivel assembly 16 and a level and securing means 64. The plate member 62 is typically attached to the base plate 46 by a mechanism resembling a hinge. In this manner, the plate member 62 can pivot about the hinge in respect to the base plate 46. The leveling and securing means 64 provide a method of leveling the apparatus 10 on uneven terrain.

The means 64 of leveling and securing the plate member 62 in a fixed position in regard to the base plate, in the preferred embodiment, consists of a threaded bolt 66 rotatably attached to the plate member 62. The threaded bolt 66 is positioned on opposite side of the plate member 62 from the hinge mechanism that attaches the plate member 62 to the base plate 46. The threaded bolt 66 engages a corresponding threaded bore 68 on the base plate 46. A handle 70 is typically attached to the top of the threaded bolt 66 to provide a means of rotating the threaded bolt 66. The leveling and securing of the plate member in regard to the base plate is provided by rotating the threaded bolt 66. A level 72 may also be installed on the plate member 62 for leveling purposes.

The elevation swivel assembly 18 also includes an upright bracket 74 perpendicularly attached to the plate member 62. A transition mounting bracket 76 is rotatably attached to the upright bracket 74. An elevation swivel bearing 78 may be installed and used between the transition mounting bracket 76 and the upright bracket 74 for smooth rotation. The rotation of the transition mounting bracket 76 in regards to the plate member 62 provides elevation adjustment for the bow attached to the archery bow sighting and tuning apparatus 10.

The transition enclosure 22 is securely attached to the transition mounting bracket 76. The transition enclosure rotates as the transition mounting bracket 76 rotates. The transition enclosure 22, in the preferred embodiment, consists of a pair of inverted channels 78 securely held apart in a spaced relationship. The channels forms an elongated body having a front end, a back end, left and right sides and a top and bottom. Elongated openings are formed along the left and right sides between the spaced apart channels 78. Transition end brackets 80 are used in the ends of the transition enclosure 22 to hold the pair of channels 78 in a spaced apart relationship.

Elevation is controlled by an elevation adjusting means 36. The elevation adjusting means 36 controls horizontal positioning of the transition enclosure 22 by controlling rotation of the transition mounting bracket 76 in regards to the plate member 62 of the elevation swivel assembly 18.

In the preferred embodiment, the elevation adjusting means 36 consists of an elevation base plate 80, a downward extension bar and an elevation adjusting rod 84. The elevation base plate 80 is attached to the transition mounting bracket 76. The downward extension bar 82 is rigidly attached to and extends downward from the elevation base plate 80. The elevation adjusting rod 84 attaches to and extends between the lower end of the downward extension bar 82 and a point on the transition enclosure 22 between the transition mounting bracket 76 and the rearward end of the transition enclosure 22. An elevation adjustment mount 86 is used to attach the elevation adjusting rod 84 to the transition enclosure 22.

The elevation adjusting rod 84 of this design includes a right hand threaded rod 130 and a left hand threaded rod 132. An appropriately threaded tube 134 receives the threaded rods 130 and 132. The threaded tube 134 is rotated to screw the threaded rods 130 and 132 in and out, similar to a turnbuckle. Elevation adjustment is made by the rotation of the threaded tube 134. The threaded tube 134 may be of an octagonal or hexagonal shape to provide a non-slip grip.

A transition piece 24 slides or moves forward and backwards within the transition enclosure 22. The purpose of the transition piece is to draw a string on a bow back to a specific draw length and to hold the string in a fixed position until released. The transition piece has a release mounting extension 88 extending outward through the elongated opening along the right side of the transition enclosure. The trigger release 34 is typically attached to the release mounting extensions by bolts.

Once the transition piece 24 has been positioned to the appropriate draw length, the sting of the bow may also be drawn back manually by the archer. The archer would simply pull the string back to engage the string in the trigger release 34 attached to the transition piece 24. A shoulder pad may be installed at the rearward end of the transition enclosure 22. The shoulder pad provides a means of bracing the apparatus 10 against the archer's body as he draws the string back.

The archery bow sighting and tuning apparatus 10 may also include a draw length indicator 90. The draw length indicator 90 provides a means of measuring and verifying the length of drawing the string back. Using the draw length indicator, the exact draw length can be duplicated repeatedly.

In the preferred embodiment, the draw length indicator 90 consists of an extension 92 from the transition piece 24 extending outward through the elongated opening along the left side of the transition enclosure 22, a pointer attached to the extension 92 and a scale along the left side of the transition enclosure. The pointer shows the position of the transition piece 24 within the transition enclosure 22 along the scale and thus the length of drawing back the string. The scale is typically in inches but can be metric or a combination of both.

The transition piece 24 is moved within the transition enclosure by a sliding and holding means 26. The sliding and holding means is typically contained within the transition enclosure 22. In the preferred embodiment, the sliding and holding means 26 consists of a transition shaft 28 rotatably extending between front and back bearings 90 contained on the front and back transition enclosure end brackets 80. The transition shaft 28 rotates within the bearings 90 by a drive assembly 30. The transition shaft 28 has a threaded portion 88 that is in engagement with a threaded bore on the transition piece 24. As transition shaft 88 rotates, the transition piece 24 is moved from a forward position to a rearward position or vice versa depending on the direction of rotation.

The transition piece 24 may also have bearings 136 that ride within the transition enclosure 22. The bearings 136 transfers the side load that would typically be put on the transition shaft 28 to the transition enclosure 22. This provides for smooth travel of the transition piece 24 and eliminating excessive wear.

The drive assembly 30 can be any number of assemblies known or unknown in the art without departing from the scope and spirit of the invention. The principal purpose is to move the transition piece 24 within the transition enclosure 22. The drive assembly 30 can rotate the transition shaft 28 by a handcrank or an electric motor attached to the end of the transition shaft 28.

In the preferred embodiment and best mode contemplated, the drive assembly 30 consists of a sprocket box 94, chain sprocket 96, drive sprocket 98, chain 100, drive shaft 102 and a rotation means 104. The sprocket box 94 is attached to the front end of the transition enclosure 22 and provides a means of mounting all the components of the drive assembly 30. The chain sprocket 96 is attached to a front end of the transition shaft 28. Typically a portion of the transition shaft 28 will extend outward from the transition enclosure end bracket 80 through the bearing contained therein. The extension is for attaching the drive assembly 30. The drive sprocket 98 is attached to the end of the drive shaft 102. The drive shaft 102 is rotatably attached to the sprocket box 94 adjacent and parallel to the transition shaft 24. The drive shaft 102 rotates to rotate the drive sprocket 98. A chain 100 connects the drive sprocket 98 to the chain sprocket 96. Therefore, as the drive shaft 102 rotates, the transition shaft 24 is rotated. A chain tensioner 106 may be used to maintain tension on the chain 100.

The rotation means 104, in the preferred embodiment, is a handwheel 108 that manually operates to rotate the drive shaft 102. An attachment extension 110 is provided for attaching an electric motor for easy and rapid operation. In this embodiment the attachment extension 110 allows use of an electric drill as the electric motor. In another embodiment, an electric motor could be permanently attached.

A bow mounting assembly 32 is provided for attaching an archery bow to the archery bow sighting and tuning apparatus 10 of this invention. Because of the design, any type of bow can be attached to the bow mounting assembly 32.

The bow mounting assembly 32 is attached to the front end of the transition enclosure 22. In the preferred embodiment and best mode contemplated, the bow mounting assembly 32 consists of a support arm mounting plate 112, a support arm 114, a spindle 116 and a bow clamp 118. The support arm mounting plate 112, in this embodiment is attached to the sprocket box 94 on the front of the transition enclosure 22. The support arm 114 is attached to the support arm mounting plate 112. Adjustment for various sizes of bows can be made by the positioning of the support arm 114 on the mounting plate 112. Slotted bolt holes are provided on the mounting plate 112 for various positioning of the support arm 114. The spindle 116 is rotatably attached to the forward end of the support arm 114. Bearings are typically used to provide a means for the spindle 116 to rotate. The bow must be able to rotate for proper operation of drawing and releasing the bow string. The bearing mounted spindle provides the means. A bow clamp 118 is than used to clamp the bow to the spindle. The bow clamp 118 consists of a bow mounting plate 120 attach to the spindle and a U-bolt 122 attached to the bow mounting plate. A protective material may be contained on the U-bolt 122 and on the bow mounting plate 120 to protect the bow mounted within the bow clamp 118.

A bow stop 124 should be used to prevent the bow from rotating when the bow string is not attached to a trigger release 34. The bow stop 124 in the preferred embodiment and best mode contemplated consists of a rod 126 having a 90 degree bend and a bow stop clamp 128. The rod 126 is simply clamped to the support arm 114 and extends downward and across in the path of the rotating bow. The rod 124 stops or limits the bow rotation.

There are a number of different trigger releases available on the market and known in the art. Each has certain advantages and disadvantages depending on the use and the user. Each archer will have his preference on the one he uses. The features of this invention allow practically all, if not all, trigger releases to be attached and used on the archery bow sighting and tuning apparatus 10. By using the trigger release of the archer, the shooting geometry is like or more resembles that of the archer.

The trigger release 34 is attached to the release mounting extension 88 by bolts or other attachment means generally via different adapters. The adapters themselves typically bolt to the mounting holes contained on the release mounting extension 88. The trigger release then attaches to the adaptor. Any trigger release and means of attachment can be used without departing from the scope and spirit of the invention.

Dynometers may also be installed on the archery bow sighting and tuning apparatus 10 for use in fine tuning the bow. The dynometer can be used to specifically measure the various characteristic of the bow in the resting state, as the string is being drawn back, as the string is held in a fixed position and as an arrow is being fired from the bow. The bow can be exactly tuned for optimum performance by making adjustments in accordance with the readings taken by the dynometer. A tension dynometer is especially useful for measuring the tension in the bow limbs to ensure equal forces are being applied to the string during shooting. Scopes and other optical devices can also be attached as desired by the user. Various jigs and adapters provided would be used for attaching the optional devices to the archery bow sighting and tuning apparatus 10.

The archery bow and sighting apparatus 10 allows any bow and any trigger release to be used. Therefore, it is very versatile. The windage swivel assembly 16 allows 360 degree rotation. An arrow can be fired in any direction. Plus, fine windage adjustment provides exact sighting of the sights contained on the bow. The elevation control allows an arrow to be shot from the bow from a minus 20 degrees to a positive 45 degrees.

The archer sets up the archery bow sighting and tuning apparatus by opening or spreading the legs 40 on the base assembly 12. The standard 44 is raised or lowered to the desired height and locked in position by clamp 46. A bow is attached in the bow mounting apparatus 32. A trigger release 34 is attached to the release mounting extension 88 on the transition piece 24. The string of the bow is engaged in the trigger release 34. The drive assembly 30 is operated to slide the transition piece 24 back to a desired draw length. An arrow is placed on the bow in a shooting position. The elevation and windage controls are adjusted to sight-in the bow. Once everything is as desired the arrow is shot from the bow. Repeated shoots can be made with the shooting geometry being exactly duplicated. As additional shots are made, the bow sights can be exactly sighted and adjusted as appropriate. The bow limb tension can also be adjusted to provide even tension when shooting. Since the geometry is exactly duplicated, defective or abnormal arrows can be found and eliminated from hunting, practice or competition quivers. Using a tuned bow and good arrows groupings of five arrows within a 1 inch radius at 100 yards have been repeatedly achieved. Thus, the archery bow sighting and tuning apparatus 10 of this invention provides for an archer to be shooting a fine tuned bow exactly sighted-in to increase his accuracy in shooting.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A archery bow sighting and tuning apparatus comprising:

a base assembly having a plurality of supporting legs and a vertical support member supported by said plurality of legs;

a standard assembly comprising a tube member having a top end and a bottom end, said bottom end inserted into said support member, said tube member slidable within said support member and lockable in a fixed position;

a windage swivel assembly comprising a base plate rotatably attached to said top end of said tube member of said standard assembly and a means to lock said windage assembly in a selected position on said standard assembly;

an elevation swivel assembly comprising a plate member pivotally attached to said base plate of said windage swivel assembly and a means of securing said plate member in a fixed position in regard to said base plate;

a transition mounting bracket rotatably attached to said plate member of said elevation swivel assembly;

a transition enclosure securely attached to said transition mounting bracket, said transition enclosure being an elongated body having a front end, a back end, left and right sides and a top and bottom;

an elevation adjusting means to control horizontal positioning of said transition enclosure by controlling rotation of said transition mounting bracket in regards to said plate member of said elevation swivel assembly;

a transition piece slidable between said front end and said back end within said transition enclosure, said transition piece having a release bracket extending outward through an elongated opening along said right side of said transition enclosure;

a means of sliding and holding said transition piece in a fixed position within said transition enclosure;

a bow mounting assembly attached to said front end of said transition enclosure for holding an archery bow for shooting an arrow; and a trigger release attached to said release bracket, said trigger release engaging a bow string on a bow mounted in said bow mounting assembly, said trigger release holding said string as said transition piece is drawn back to a position corresponding to a bow draw length, and said trigger release operated to release said string to shoot an arrow from said bow.

2. The archery bow sighting and tuning apparatus as set forth in claim 1 further comprising a windage swivel bearing inserted into said top end of said tube member of said standard assembly and a bearing stand off ring contained on a bottom surface of said base plate of said windage swivel assembly for rotatably attaching said windage swivel assembly on said tube member of said standard assembly.

3. The archery bow sighting and tuning apparatus as set forth in claim 1 in which said elevation swivel assembly further comprising a level adjustment means for a controlled pivoting of said plate member in regards to said base plate and securing said plate member is a level position.

4. The archery bow sighting and tuning apparatus as set forth in claim 1 in which said elevation adjusting means comprises an elevation base plate attached to said transition mounting bracket, a downward extension bar rigidly attached to said base plate, and an elevation adjusting rod attached to and extending between a bottom end of said downward extension bar and an elevation adjustment mount positioned on said transition enclosure at a position between the said back end of said transition enclosure and said transition mounting bracket.

5. The archery bow sighting and tuning apparatus as set forth in claim 1 in which said transition piece further comprises a draw length indicator.

6. The archery bow sighting and tuning apparatus as set forth in claim 5 in which said draw length indicator comprises an extension from said transition piece extending outward from an elongated opening along said left side of said transition enclosure, and a scale along said left side of said transition enclosure for a pointer attached to said extension to indicate the position of said transition piece within said transition enclosure.

7. The archery bow sighting and tuning apparatus as set forth in claim 1 in which said means of sliding and holding said transition piece within said transition enclosure comprises a transition shaft extending between front and back bearings attached and enclosed at said front and back ends of said transition enclosure, said transition shaft rotated within said bearings by a rotation means, said transition shaft having a threaded portion in engagement with a threaded bore on said transition piece, such that said transition piece slides within said transition enclosure as said transition shaft is rotated.

8. The archery bow sighting and tuning apparatus as set forth in claim 7 in which said rotation means comprises a sprocket box attached to said front end of said enclosure means, a chain sprocket attached to a front end of said transition shaft extending outward from said bearing at said front of said transition enclosure, a drive shaft rotatably attached to said sprocket box adjacent to said transition shaft, a drive sprocket attached to an end of said drive shaft, a chain engaging said chain sprocket and said drive sprocket, and a means of rotating said drive shaft.

9. The archery bow sighting and tuning apparatus as set forth in claim 8 in which said means of rotating said drive shaft comprises a manual handwheel attached to an end of said drive shaft.

10. The archery bow sighting and tuning apparatus as set forth in claim 8 in which said means of rotating said drive means includes an electric motor means.

11. The archery bow sighting and tuning apparatus as set forth in claim 8 in which said means of rotating said drive shaft comprises a manual handwheel and a shaft for attaching an electric motor means.

12. The archery bow sighting and tuning apparatus as set forth in claim 7 in which said rotation means comprises an electric motor means.

13. The archery bow sighting and tuning apparatus as set forth in claim 1 in which said bow mounting assembly comprising a support arm mounting plate attached to the front end of said transition enclosure, a support arm attached to said support arm mounting plate, support arm bearings at an end of said support arm not attached to said support arm mounting plate, a spindle rotatably engaging and secured within said support arm bearings and a bow clamp attached to said spindle.

14. The archery bow sighting and tuning apparatus as set forth in claim 13 in which said bow clamp comprises a bow mounting plate attachable to said spindle and a U-bolt attached to said bow mounting plate.

15. The archery bow sighting and tuning apparatus as set forth in claim 14 in which said bow clamp further comprises protective material contained on said U-bolt and on said bow mounting plate to protect a bow mounted within said bow clamp.

16. The archery bow sighting and tuning apparatus as set forth in claim 1 further comprising a bow stop attached to said bow mounting assembly, said bow stop to limit rotation of a bow mounted within said bow mounting assembly, said bow stop comprising a rod having a bend attached to said bow mounting assembly by a clamp.

17. The archery bow sighting and tuning apparatus as set forth in claim 1 further comprising a windage adjustor for fine adjustment of said windage swivel assembly, said windage adjustor attached to said windage swivel assembly for rotating said windage swivel assembly in respect to said standard assembly.

18. The archery bow sighting and tuning apparatus as set forth in claim 17 in which said windage adjustor comprising an adjustor housing attached to said windage swivel assembly, a threaded adjustor rod rotatably attached within said adjustor housing, an adjustor nut having a threaded bore engaging said threaded adjustor rod such that said adjustor nut moves within said adjustor housing as said adjustor rod rotates, and a windage adjustor handwheel for rotating said threaded adjustor rod, said adjustment nut engaging said standard assembly for rotating said windage swivel assembly in respect to said standard assembly as said threaded adjustment rod is rotated.

19. A archery bow sighting and tuning apparatus comprising:

a base assembly having a plurality of supporting legs and a vertical support member supported by said plurality of legs;

a standard assembly comprising a tube member having a top end and a bottom end, said bottom end inserted into said support member, said tube member slidable within said support member and lockable in a fixed position;

a windage swivel assembly comprising a base plate, a windage swivel bearing inserted into said top end of said tube member of said standard assembly and a bearing stand off ring contained on a bottom surface of said base plate of said windage swivel assembly for rotatably attaching said windage swivel assembly to said tube member of said standard assembly and a means to lock said windage assembly in a selected position on said standard assembly;

an elevation swivel assembly comprising a plate member pivotally attached to said base plate of said windage swivel assembly, and a level adjustment means for controlled pivoting of said plate member in regards to said base plate and securing said plate member in a level position;

a transition mounting bracket rotatably attached to said plate member of said elevation swivel assembly;

a transition enclosure securely attached to said transition mounting bracket, said transition enclosure having a front end, a back end, left and right sides and a top and bottom:

an elevation adjusting means to control horizontal positioning of said transition enclosure in regards to said plate member of said elevation swivel assembly, said elevation adjusting means comprising an elevation base plate attached to said transition mounting bracket, an downward extension bar rigidly attached to said base plate, and an elevation adjusting rod attached to and extending between a bottom end of said downward extension bar and an elevation adjustment mount positioned on said transition enclosure at a position between the said back end of said transition enclosure and said transition mounting bracket;

a transition piece slidable between said front end and said back end within said transition enclosure, said transition piece having a release bracket with release bracket mounting holes extending outward through an elongated opening along said right side of said transition enclosure and a draw length indicator extension extending outward from an elongated opening along said left side of said transition enclosure a scale along said left side of said transition enclosure for a pointer attached to said extension on said transition piece to indicate the position of said transition piece within said transition enclosure;

a transition shaft extending between front and back bearings attached and enclosed at said front and back ends of said transition enclosure, said transition shaft rotatable within said bearings, said transition shaft having a threaded portion extending through and in engagement with a threaded bore on said transition piece, such that said transition piece slides within said transition enclosure as said transition shaft is rotated;

a rotation means for rotating said transition shaft comprising a sprocket box attached to said front end of said enclosure means, a chain sprocket attached to a front end of said transition shaft extending outward from said bearing at said front of said transition enclosure, a drive shaft rotatably attached to said sprocket box adjacent to said transition shaft, a drive sprocket attached to an end of said drive shaft, a chain engaging said chain sprocket and said drive sprocket, a handwheel for manually rotating said drive shaft and an extension from said handwheel for attaching an electro-mechanical means for rotating said drive shaft, a bow mounting assembly comprising a support arm mounting plate attached to said front end of said transition enclosure, a support arm attached to said support arm mounting plate, support arm bearings at an end of said support arm not attached to said support arm mounting plate, a spindle rotatably engaging and secured within said support arm bearings and a bow clamp attached to said spindle, said bow clamp comprising a bow mounting plate attachable to said spindle and a U-bolt attached to said bow mounting plate;

a bow stop attached to said support arm, said bow stop to limit rotation of a bow mounted within said spindle, said bow stop comprising a rod having a bend attached to said support arm; and a trigger release attached to said release bracket mounting holes, said trigger release engaging a bow string on a bow mounted in said bow mounting assembly, said trigger release holding said string as said transition piece is drawn back to a position corresponding to a bow draw length, and said trigger release operated to release said string to shoot an arrow from said bow.

20. A archery bow sighting and tuning apparatus comprising:

a telescoping base assembly held in a vertical position by a base having a standard slidable within a tube member, said standard being lockable in a fixed position within said tube member;

a base plate rotatably attached to said top end of said standard with a means to lock said base plate in a selected position on said standard assembly;

an elevation plate member pivotally attached to said base plate with a means of pivoting and securing said plate member in a fixed position in regard to said base plate;

a transition mounting bracket rotatably attached to said elevation plate member;

a transition enclosure attached to said transition mounting bracket;

an elevation adjusting rod to control rotation of said transition mounting bracket and horizontal positioning of said transition enclosure;

a transition piece slidable within said transition enclosure, said transition piece having a release mount bracket extending outward through an elongated opening along a side of said transition enclosure;

a transition shaft rotatably contained within said transition enclosure to slide said transition piece within said transition enclosure and to hold said transition piece in a fixed and known position within said transition enclosure;

a means of rotating said transition shaft;

a bow mounting assembly attached to a front end of said transition enclosure for holding an archery bow; and a trigger release attached to said release mounting bracket, said trigger release engaging a bow string on a bow mounted in said bow mounting assembly, said trigger release holding said string as said transition piece is drawn back to a position corresponding to a bow draw length, and said trigger release operated to release said string to shoot an arrow from said bow.

* * * * *